US010287753B2

(12) United States Patent
Vegunta et al.

(10) Patent No.: US 10,287,753 B2
(45) Date of Patent: May 14, 2019

(54) EXCAVATING TOOTH ASSEMBLY WITH LOCKING PIN ASSEMBLY

(71) Applicant: Hensley Industries, Inc., Dallas, TX (US)

(72) Inventors: Venkata Prakash Vegunta, Dallas, TX (US); Mohamad Youssef Bilal, Little Elm, TX (US)

(73) Assignee: Hensley Industries, Inc., Dallas, TX (US)

( * ) Notice: Subject to any disclaimer, the term of this patent is extended or adjusted under 35 U.S.C. 154(b) by 0 days.

(21) Appl. No.: 16/042,724

(22) Filed: Jul. 23, 2018

(65) Prior Publication Data

US 2018/0328005 A1 Nov. 15, 2018

Related U.S. Application Data

(63) Continuation of application No. 15/282,363, filed on Sep. 30, 2016, now Pat. No. 10,030,368.

(60) Provisional application No. 62/237,805, filed on Oct. 6, 2015.

(51) Int. Cl.
*E02F 9/28* (2006.01)

(52) U.S. Cl.
CPC ..... *E02F 9/2841* (2013.01); *E02F 9/2825* (2013.01)

(58) Field of Classification Search
CPC ..... E02F 9/2809; E02F 9/2825; E02F 9/2841; E02F 9/2883; E02F 9/2833; E02F 9/28; E02F 9/2816; E02F 9/2858; F16B 1/00; F16B 19/02; F16B 21/00; F16B 21/10; F16B 21/12; F16B 21/125; F16B 21/20; F16B 2021/14
USPC ..... 37/446, 452–460; 172/701.1–701.3, 713; 299/102, 103, 106, 108; 403/318, 319, 403/294, 355, 153, 154, 374.1–374.4, 403/379, 379.4
See application file for complete search history.

(56) References Cited

U.S. PATENT DOCUMENTS 4,133,121 A 1/1979 Hemphill
4,823,487 A 4/1989 Robinson
5,233,770 A 8/1993 Robinson
(Continued)

FOREIGN PATENT DOCUMENTS

WO WO 2014/121318 A1 8/2014

OTHER PUBLICATIONS

International Search Report and Written Opinion dated Dec. 30, 2016 in connection with International Application No. PCT/US16/55198; 8 pp.

*Primary Examiner* — Robert E Pezzuto
(74) *Attorney, Agent, or Firm* — Haynes and Boone, LLP

(57) ABSTRACT

A locking pin assembly for securing a ground engaging element to a support structure may include a body portion and may include a shaft portion disposed within the body portion and rotatable between a first position that mechanically inhibits removal of a ground engaging element from a support structure and a second position that permits removal of the ground engaging element from the support structure. A camshaft may be rotatably disposed within the shaft portion and may be arranged to cooperate with the shaft portion to rotate through a first range of motion and to apply a rotational force on the shaft portion through a second range of motion. A radially extending locking element may be configured to selectively mechanically interfere with one of the shaft portion and the body portion to selectively prevent rotation of the shaft portion relative to the body portion.

23 Claims, 21 Drawing Sheets

(56) References Cited

U.S. PATENT DOCUMENTS

| | | | |
|---|---|---|---|
| 5,361,520 | A | 11/1994 | Robinson |
| 5,394,629 | A | 3/1995 | Ruvang et al. |
| 5,491,915 | A | 2/1996 | Robinson |
| 5,718,070 | A | 2/1998 | Ruvang |
| 6,108,950 | A | 8/2000 | Ruvang et al. |
| 6,439,796 | B1 | 8/2002 | Ruvang et al. |
| 6,708,431 | B2 | 3/2004 | Robinson et al. |
| 6,779,386 | B2 | 10/2004 | Robinson et al. |
| 6,976,325 | B2 | 12/2005 | Robinson et al. |
| 7,069,676 | B2 | 7/2006 | Robinson et al. |
| 7,121,023 | B2 | 10/2006 | Robinson et al. |
| 7,162,828 | B1 | 1/2007 | Ruvang et al. |
| 7,603,799 | B2 | 10/2009 | Campomanes |
| 7,681,341 | B2 | 3/2010 | Ruvang |
| RE41,855 | E | 10/2010 | Ruvang et al. |
| 8,387,290 | B2 | 3/2013 | Campomanes et al. |
| 8,898,937 | B2 | 12/2014 | Campomanes |
| 8,904,677 | B2 | 12/2014 | Cui |
| 8,931,190 | B2 | 1/2015 | Knight |
| 9,009,995 | B2 | 4/2015 | Freund et al. |
| 2005/0229443 | A1 | 10/2005 | Bierwith |
| 2006/0265916 | A1 | 11/2006 | Carpenter et al. |
| 2007/0261278 | A1 | 11/2007 | Campomanes |
| 2008/0028644 | A1 | 2/2008 | Lopez Almendros et al. |
| 2009/0205228 | A1 | 8/2009 | Ruvang |
| 2012/0051836 | A1 | 3/2012 | Jakubisin |
| 2012/0055052 | A1 | 3/2012 | Campomanes et al. |
| 2014/0186105 | A1 | 7/2014 | Martinelli et al. |
| 2014/0223784 | A1 | 8/2014 | Endersby et al. |
| 2014/0298692 | A1 | 10/2014 | Marchand |
| 2014/0331529 | A1 | 11/2014 | Guimaraes et al. |
| 2015/0007464 | A1 | 1/2015 | Simpson et al. |
| 2015/0027009 | A1 | 1/2015 | Vannitamby et al. |
| 2015/0113839 | A1 | 4/2015 | Bilal |

EXCAVATING TOOTH ASSEMBLY WITH LOCKING PIN ASSEMBLY

PRIORITY

This application is a continuation of U.S. application Ser. No. 15/282,363, filed Sep. 30, 2016, now U.S. Pat. No. 10,030,368 which claims priority to Provisional Patent Application No. 62/237,805, filed Oct. 6, 2015, and entitled "Excavating Tooth Assembly With Locking Pin Assembly," the disclosures of which are hereby incorporated by reference in their entirety.

TECHNICAL FIELD

This disclosure is generally directed to an excavating tooth assembly including a locking pin assembly that secures components of the excavating tooth assembly. More particularly, this disclosure is directed to an excavating tooth assembly secured by a releasable locking pin assembly having an improved locking structure with rotational interference to prevent inadvertent unlocking.

BACKGROUND

Material displacement apparatuses, such as excavating buckets found on construction, mining, and other earth moving equipment, often include replaceable wear portions such as earth engaging teeth. These are often removably carried by larger base structures, such as excavating buckets, and come into abrasive, wearing contact with the earth or other material being displaced. For example, excavating tooth assemblies provided on digging equipment, such as excavating buckets and the like, typically comprise a relatively massive adapter portion which is suitably anchored to the forward bucket lip. The adapter portion typically includes a reduced cross-section, forwardly projecting nose. A replaceable tooth point typically includes an opening that releasably receives the adapter nose. To retain the tooth point on the adapter nose, generally aligned transverse openings are formed on both the tooth point and the adapter nose, and a suitable connector structure is driven into and forcibly retained within the aligned openings to releasably anchor the replaceable tooth point on its associated adapter nose.

There are a number of different types of conventional connector structures. One type of connector structure typically has to be forcibly driven into the aligned tooth point and adapter nose openings using, for example, a sledge hammer Subsequently, the inserted connector structure has to be forcibly pounded out of the point and nose openings to permit the worn point to be removed from the adapter nose and replaced. This conventional need to pound in and later pound out the connector structure can easily give rise to a safety hazard for the installing and removing personnel.

Various alternatives to pound-in connector structures have been previously proposed to releasably retain a replaceable tooth point on an adapter nose. While these alternative connector structures desirably eliminate the need to pound a connector structure into and out of an adapter nose, they typically present various other types of problems, limitations, and disadvantages including, but not limited to, complexity of construction and use, undesirably high cost, and the necessity of removing the connector structure prior to removal or installation of the replaceable tooth point.

Some types of connector structures are rotatable between a locked position and an unlocked position. However, the continuous vibration, high impact, and cyclic loading of the tooth point can result in inadvertent rotation of the connector structure from a locked position to an unlocked position. This may cause excess wear on the connector structure and tooth point interface and may affect the useful life of both the connector structure and the tooth point.

A need accordingly exists for an improved connector structure.

SUMMARY

According to one exemplary aspect, the present disclosure is directed to a locking pin assembly for securing a ground engaging element having side openings to a support structure alignable with the side openings. The locking pin assembly may include a body portion having a non-circular profile and being arranged to non-rotatably, selectively extend into the support structure. It may also include a shaft portion disposed within the body portion and rotatable between a first position that mechanically inhibits removal of the ground engaging element from the support structure and a second position that permits removal of the ground engaging element from the support structure. The shaft portion may include an opening formed therein. A camshaft may be rotatably disposed within the opening of the shaft portion. The camshaft may be arranged to cooperate with the shaft portion to rotate within the shaft portion through a first range of motion and to apply a rotational force on the shaft portion through a second range of motion. The locking pin assembly may include a radially extending locking element carried by one of the shaft portion and the body portion. It may be configured to selectively mechanically interfere with the other of the shaft portion and the body portion to selectively prevent rotation of the shaft portion relative to the body portion.

The locking element may include a lock portion and a cam interfacing portion. In some aspects, the cam interfacing portion is being selectively engageable with the camshaft. The locking pin assembly may include a biasing element carried by the shaft portion. The biasing element may bias the locking element to a position that mechanically engages with the body portion. In some aspects, the camshaft may be rotatable about an axis substantially parallel to an axis of the shaft portion. The camshaft may interact with the locking element against a force applied by the biasing element to radially displace the locking element. In some aspects, the shaft portion may include a groove formed therein, and the body portion may carry a rotation stopping element. The rotation stopping element may mechanically interfere with a portion of the groove to limit a range of rotation of the shaft portion relative to the body portion. The body portion may include an inner surface with a radially extending opening therein. The locking element may be configured to automatically enter the radially extending opening therein when the locking element is aligned with the radially extending opening. The camshaft may include a groove formed therein, and the shaft portion may carry a rotation stopping element. The rotation stopping element may mechanically interfere with a portion of the groove to limit a range of rotation of the camshaft relative to the shaft portion. The camshaft may transfer applied torque loading to the shaft portion only after the camshaft reaches a rotational limit. In some aspects, the groove of the camshaft is a partially circumferential groove having end portions, and the rotation stopping element may be fixed in place relative to the shaft portion and selectively engageable with the end portions to prevent rotation of the camshaft relative to the shaft portion when the range of rotation is exceeded. In some aspects, the end portions of the groove permit rotation of the camshaft about 120 degrees relative to the shaft portion.

In some exemplary aspects, the present disclosure is directed to methods for locking a wear member to or removing a wear member from an adapter carried on earth engaging equipment using a locking pin assembly. The method may include rotating a camshaft relative to a shaft portion in a first direction through a first range of motion until the camshaft engages a stop element on the shaft portion; and rotating the shaft portion relative to a body portion in the first direction by continuing to rotate the camshaft through a second range of motion until a locking element carried by one of the shaft portion and the body portion prevents further rotation of the shaft portion relative to the body portion in the first direction and in an opposing second direction. One of the shaft portion and the body portion may prevent removal of the wear member from the adapter.

In some aspects, the method may include introducing a wear member over an adapter member of the earth engaging equipment so that the wear member passes over protruding tabs of the shaft portion. The protruding tabs may be displaceable with the shaft portion from a first position that permits the wear member to pass over the protruding tabs to a second position that mechanically prevents removal of the wear member from the adapter. The method may also include rotating the camshaft relative to the shaft portion in the second direction until the camshaft displaces the locking element so that the locking element no longer prevents rotation of the shaft portion relative to the body portion in the second direction. It may also include rotating the shaft portion relative to the body portion in the second direction by continuing to rotate the camshaft until the shaft portion is positioned to permit removal of a wear member from the adapter. In some aspects, rotating the camshaft relative to the shaft portion in the second direction until the camshaft displaces the locking element may include compressing a biasing element that biases the locking element toward a locked position. In some aspects, rotating the camshaft relative to the shaft portion includes rotating the camshaft through a range of motion in a range between 1 and 180 degrees, and rotating the shaft portion relative to the body portion includes rotating the shaft portion through a range of motion in a range between 90 and 300 degrees.

In another exemplary aspect, the present disclosure is directed to a locking pin assembly that includes a first shaft portion rotatable between a first position that mechanically inhibits removal of the ground engaging element from the support structure and a second position that permits removal of the ground engaging element from the support structure. The first shaft portion may have an opening formed therein. A second shaft portion may be rotatably disposed within the opening of the first shaft portion and may be rotatable relative to the first shaft portion. The second shaft portion may be arranged to cooperate with the first shaft portion to rotate within the first shaft portion through a first range of motion and to apply a rotational force on the first shaft portion through a second range of motion. A radially extending locking element may be carried by one of the first shaft portion and the second shaft portion and configured to selectively radially project and retract to selectively prevent rotation of one of the first shaft portion and the second shaft portion relative to the ground engaging element.

In some aspects, the locking element may include a lock portion and a cam interfacing portion. The locking pin assembly may include a cam. The cam interfacing portion may be selectively engageable with the cam to retract the locking element. In some aspects, the locking pin assembly may include a biasing element carried by one of the first shaft portion and the second shaft portion. The biasing element may bias the locking element to a position that mechanically prevents rotation of one of the first shaft portion and the second shaft portion relative to the ground engaging element.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following.

BRIEF DESCRIPTION OF THE DRAWINGS

The accompanying drawings illustrate implementations of the systems, devices, and methods disclosed herein and together with the description, serve to explain the principles of the present disclosure.

Figure 1:
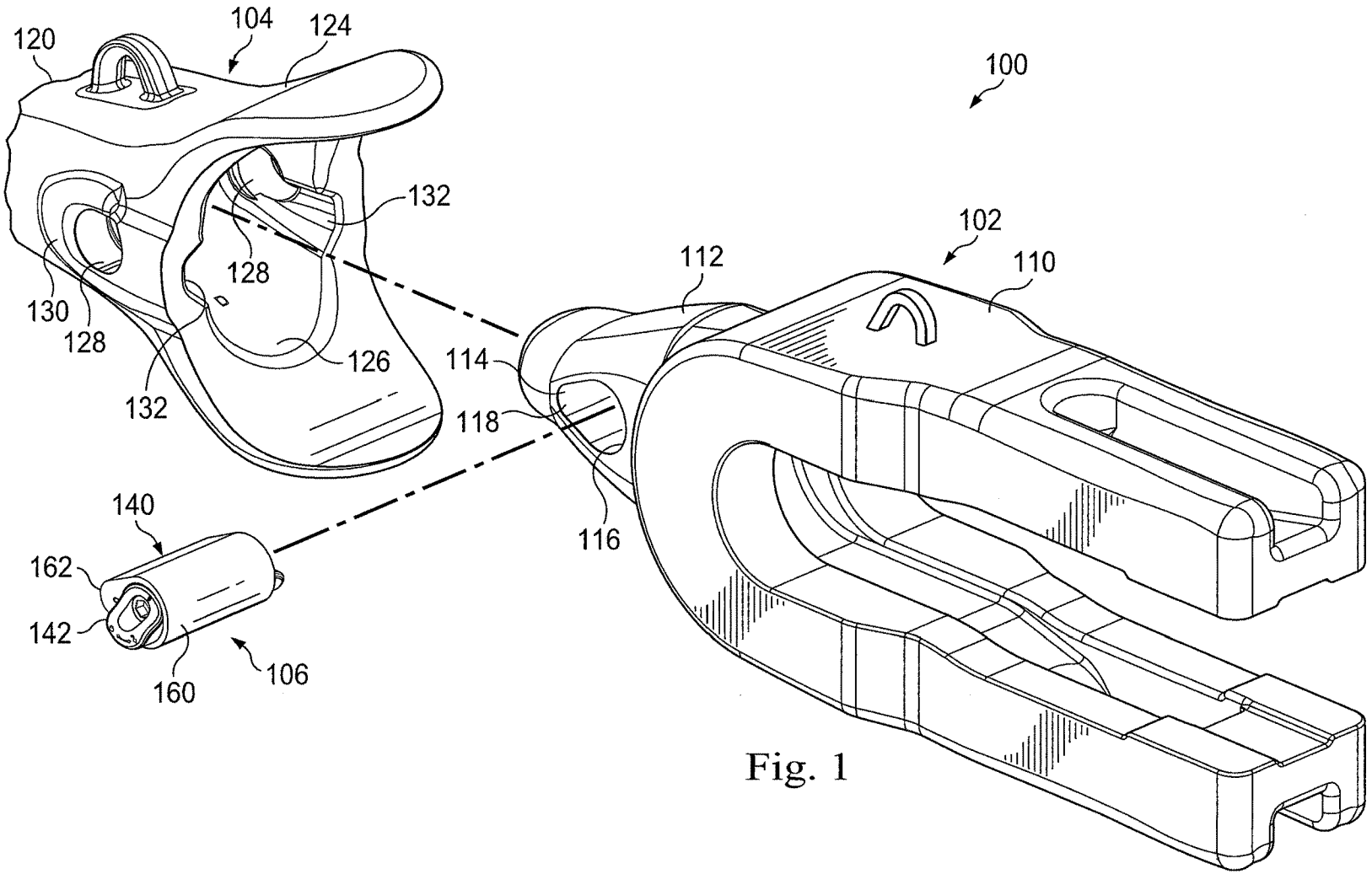
FIG. 1 is an exploded perspective view of an excavating tooth assembly embodying principles of the present disclosure.

These Figures will be better understood by reference to the following Detailed Description

DETAILED DESCRIPTION

For the purposes of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to an excavating tooth assembly including a locking pin assembly that is arranged to statically and removably secure an adapter to a wear member such as an excavating tooth. The locking pin assembly includes a radially movable locking element that mechanically prevents the locking pin assembly from inadvertently moving from a locked position to an unlocked position. The locking pin assembly may advance or retract the radially movable locking element using a cam member. In addition, the locking pin assembly may be moved between a locked position and an unlocked position using a two-step rotation process. The two-step process may include rotating a first element, such as a camshaft, that affects the radially movable locking element and may include engaging and rotating a second element, such as a shaft portion, when the first element reaches a limit of rotation.

Since the locking pin assembly employs mechanical interference to prevent inadvertent rotation of locking pin assembly components, the locking pin assembly may be able to withstand vibration, high-impact, and cyclic loading while minimizing the chance of becoming inadvertently unlocked. In addition, some embodiments of the locking pin assembly may be arranged to emit an audible noise such as a click when the locking pin assembly achieves a locked condition. Because of this, users such as machinery operators may have an easier time installing new wear members and replacing old wear members than can be done with conventional connector pins.

FIG. 1 shows an exemplary embodiment of an excavating tooth assembly 100 including a support structure representatively in the form of an adapter 102, a wear member representatively in the form of a replaceable tooth point 104, and a locking pin assembly 106. The excavating tooth assembly 100 may find particular utility on earth moving equipment. For example, the excavating tooth assembly 100 may be used in construction, mining, drilling, and other industries. The adapter 102 has a rear base portion 110 from which a nose portion 112 forwardly projects, the nose portion 112 having a horizontally elongated elliptical cross-section along its length and having a non-circular transverse connector opening 114 extending horizontally therethrough between the opposite vertical sides of the nose portion 112. Here, the connector opening 114 is a teardrop-shaped oval with the rear portion 116 formed of an arc having a relatively larger radius, and shaped with a leading portion 118 formed of an arc having a relatively smaller radius. Although shown as oval-shaped, other noncircular shapes may be used.

The replaceable tooth point 104 has a front end 120, a rear end 124 through which a nose-receiving socket 126 forwardly extends, and a horizontally opposed pair of horizontally elongated elliptical connector openings 128 extending inwardly through thickened external boss portions 130 into the interior of the socket 126. The interior surface of the socket 126 has a configuration substantially complementary to the external surface of the adapter nose portion 112. A horizontally opposed pair of generally rectangular recesses 132 is formed in interior vertical side wall surface portions of the tooth point 104 and extend forwardly through the rear end 124 of the tooth point 104. As will become apparent in the discussion that follows, each of these recesses 132 has a height less than the heights of the connector openings 128 and, in the exemplary embodiment shown, forwardly terminates at a bottom portion of one of such connector openings 128. Thus, each recess 132 may have a front or inner end portion which is defined by a side surface of an associated connector opening 128. This front or inner end portion of each recess 132 may be enlarged relative to a rear or outer end portion of the recess 132 in a direction parallel to the inner side surface of the tooth point side wall in which the recess 132 is formed.

The locking pin assembly 106 is sized and shaped to be received within the connector opening 114 of the adapter 102. As described herein, the locking pin assembly 106 may removably secure the tooth point 104 in place on the adapter 102. In addition, the locking pin assembly 106 may be manipulated between an unlocked position and a locked position. In the unlocked position, the tooth point 104 may be introduced over the connector pin assembly and the nose portion 112 of the adapter 102. When the tooth point 104 is properly positioned on the adapter 102, the locking pin assembly 106 may be manipulated from the unlocked position to the locked position. When in the locked position, the locking pin assembly 106 may prevent removal of the tooth point 104 from the adapter 102 by mechanically blocking the tooth point 104. When desired, a user such as an operator may manipulate the locking pin assembly 106 from the locked position to the unlocked position. This may permit the user to remove the tooth point 104 from the adapter 102.

The locking pin assembly 106 includes, among other components, a body portion 140 and a shaft portion 142. The body portion 140 has a noncircular external surface configuration that, in this exemplary embodiment, corresponds with the shape of the connector opening 114 in the adapter 102. Accordingly, the body portion 140 is formed with a teardrop oval shape that includes a rear portion 160 having a larger radius and a leading portion 162 having a smaller radius. In this exemplary embodiment, the body portion 140 is sized and shaped to have a clearance fit within the connector opening 114, while simultaneously preventing rotation of the body portion 140 relative to the adapter 102. The shaft portion 142 is disposed within and may extend from opposing ends of the body portion 140. The shaft portion 142 may be rotated to change the locking pin assembly 106 from the unlocked position to the locked position and back again.

Figure 2:
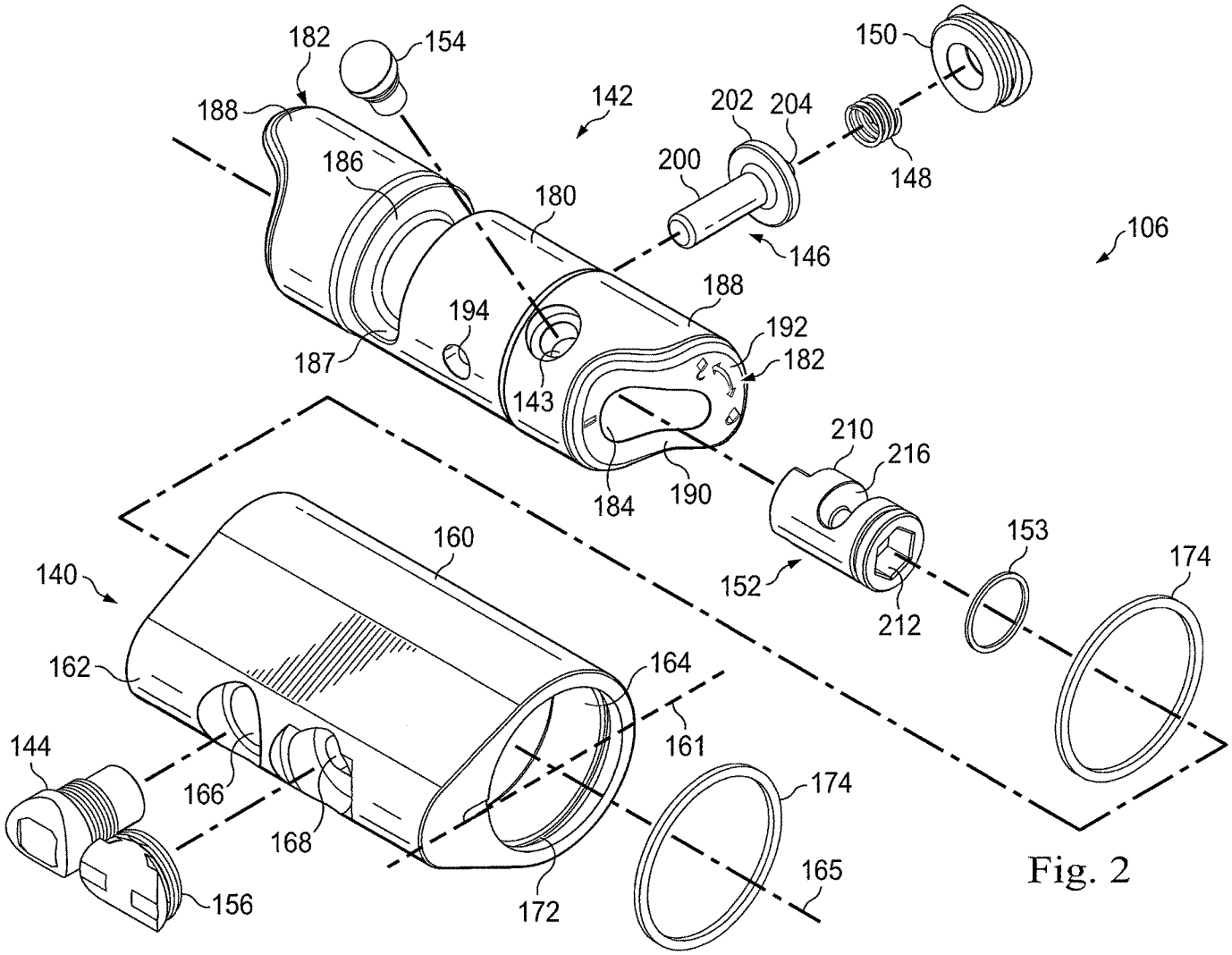
FIG. 2 is an exploded perspective view of an example locking pin assembly embodying principles of the present disclosure.

The body portion 140, the shaft portion 142, and other components of the locking pin assembly 106, may be best seen in the exploded view of FIG. 2. The locking pin assembly 106 may include the body portion 140, the shaft portion 142, a shaft rotation stop element 144, a locking element 146, a biasing element 148, a backstop 150, a camshaft 152, a cam rotation stop element 154, and a plug 156.

The body portion 140 is sized and arranged to mechanically interface with the connector opening 114 of the adapter 102 as indicated with reference to FIG. 1. Accordingly as described above, the body portion 140 has a noncircular peripheral profile or shape that prevents rotation of the body portion 140 relative to the adapter 102. In this exemplary oval-shaped embodiment, the body portion 140 has a major axis 161 extending through the center points defined by the radii of the rear portion 160 and the leading portion 162. The body portion 140 includes a main bore 164 extending from one end to the other, a stop element bore 166 and a locking bore 168. In this embodiment, the main bore 164 is a through bore having a longitudinal axis 165. The stop element bore 166 and the locking bore 168 each intersect the main bore 164. The stop element bore 166 may be sized and shaped to receive the shaft rotation stop element 144. The stop element bore 166 may, in some embodiments, be a through bore. In other embodiments, the stop element bore 166 extends only partway through the body portion 140.

The locking bore 168 also may or may not extend through the body portion 140. In the example in FIG. 2, the locking bore 168 is formed substantially parallel to the major axis 161. However, in other embodiments, the locking bore 168 may be formed at any angle relative to the major axis 161. A cross-sectional view of the locking bore 168 can be seen in FIGS. 5B and 6B. The locking bore 168 extends through structure of the body portion 140 that retains the locking element 146 to prevent rotation of the shaft portion 142. In this embodiment, the major axis 161 passes through the portion of the body portion 140 having the greatest structural integrity and wall thickness about the main bore 164. As will be described herein, the locking bore 168 may mechanically interfere with the locking element 146 to prevent rotation of the shaft portion 142 when the locking pin assembly 106 is in the locked condition. In the exemplary embodiment shown, the body portion 140 includes grooves 172 formed therein adjacent each end to receive O-rings 174. The O-rings 174 may inhibit the entry of undesired material into the main bore 164 of the body portion 140 when the shaft portion 142 is rotatably received therein.

The shaft portion 142 is sized and arranged to fit within the main bore 164 of the body portion 140. In this embodiment, the shaft portion 142 is fit with a clearance fit so that it may rotate around the longitudinal axis 165 of the main bore 164. The shaft portion 142 has a cylindrically shaped outer surface 180, end tabs 182, and a shaft main bore 184. The outer surface 180 is, in this embodiment, substantially cylindrically shaped, so that the shaft portion 142 may rotate in the main bore 164 of the body portion 140.

The outer surface 180 includes a circumferentially extending lock groove 186 formed therein on a longitudinally central portion of the shaft portion 142. Here, the lock groove 186 extends only partially about the circumference of shaft portion 142. In this embodiment, the lock groove 186 may extend through an arc within a range of 120° and 340°. A cross-sectional view of the lock groove 186 can be seen in FIG. 5C. In some embodiments, the lock groove 186 may extend through an arc extending greater than 180 degrees. In some of these embodiments, the lock groove 186 may extend through an arc within the range of 200° and 340°. In some examples, the arc will extend about 240°. The lock groove 186 may cooperate with the shaft rotation stop element 144 to limit the amount of rotation that can occur relative to the body portion 140. The lock groove 186 may have a width sufficiently sized to receive the shaft rotation stop element 144. Particularly, ends 187 of the lock groove 186 (best seen in FIG. 5C) may be used as rotation stops to limit rotation of the shaft portion 142 relative to the body portion 140 and the shaft rotation stop element 144.

The end tabs 182 are projections disposed at and extending from opposite ends of the shaft portion 142. Each end tab 182 has an arcuate laterally outer side surface 188 which is a continuation of a curved side surface portion of the cylindrical outer surface 180, and an opposing, generally planar laterally inner side surface 190 which extends generally chordwise of the shaft portion 142. Each tab 182 longitudinally terminates at a flat end surface 192 of the shaft portion 142, with the shaft main bore 184 extending inwardly through a portion of each flat end surface 192. In this exemplary embodiment, the shaft main bore 184 is slightly laterally offset from a longitudinal axis of the shaft portion 142, which in this embodiment, is shown coaxial with the longitudinal axis 165. In other embodiments, however, the shaft main bore 184 is aligned with the longitudinal axis 165 of the shaft portion 142.

The shaft portion 142 may also include a lateral lock pin bore 194 that intersects the shaft main bore 184. The lock pin bore 194 is shown in cross-section in FIG. 5B. The lock pin bore 194 is sized and shaped to receive and cooperate with the locking element 146, the biasing element 148, and the backstop 150. It may extend entirely through the shaft portion 142. In FIG. 5B, the lock pin bore 194 includes two portions having different diameters, with both portions intersecting the bore 184. The portions, referenced in FIG. 5B by the references 194*a* and 194*b* are each respectively sized to fit different portions of the locking element 146. In some embodiments, the lock pin bore portion 194*a* has substantially the same width or diameter as the locking bore 168. An opening to the lock pin bore 194 permits the locking element 146 to selectively project radially out of the locking bore 194, beyond the outer surface 180 of the shaft portion 142, and into the locking bore 168 formed in the body portion 140. When so extended, the locking element 146 prevents rotation of the shaft portion 142 relative to the body portion 140.

The stop element bore 143 intersects the shaft main bore 184. The stop element bore 143 may be sized and shaped to receive the cam rotation stop element 154. The stop element bore 143 may, in some embodiments be a through bore. In other embodiments, the stop element bore 143 extends only partway through the shaft portion 142.

The shaft rotation stop element 144 may be sized and shaped to fit through the stop element bore 166. When the shaft portion 142 is disposed within the main bore 164 of the body portion 140, the shaft rotation stop element 144 may be aligned to fit within the lock groove 186 and prevent axial displacement of the shaft portion 142 relative to the body portion 140, while permitting limited rotational displacement. Accordingly, the shaft rotation stop element 144 may function to prevent axial movement, and also prevent rotation of the shaft portion 142 beyond limits allowed by the ends of the partially circumferential lock groove 186.

The locking element 146 includes a longitudinally extending cylinder portion 200 having a cam flange 202 and a biasing element interfacing portion 204. The cylinder portion 200 may have a width, which in this embodiment is a diameter, sized to permit the cylinder portion 200 to extend from the lock pin bore 194. In other embodiments, the cylinder portion 200 is not shaped as a cylinder, but may be any type of lock portion, and may be shaped in cross-section as a square or some other polygonal shape. The cam flange 202 may have a width or size larger than a diameter of the first portion 194*a* lock pin bore 194 as shown in FIG. 5B. As will be described herein, the cam flange 202 may cooperate with the camshaft 152 to displace the locking element 146 radially relative to the shaft portion 142. As such, the cam flange 202 may be disposed within the shaft main bore 184 and the lock pin bore 194. Although described as a flange, the cam flange 202 may be another type of cam interfacing portion. For example, it may be a shoulder, a boss, a projection or other body portion. The biasing element interfacing portion 204 may interface with the biasing element 148.

The biasing element 148 may bias the locking element 146 to a lock position, where the cylinder portion 200 projects out of the lock pin bore 194 and into the locking bore 168 of the body portion 140. In this exemplary embodiment, the biasing element 148 is a coil spring. However, other types of springs or other biasing elements are contemplated. The backstop 150 provides a solid surface from which the biasing element 148 may apply its biasing load. In this embodiment, the backstop 150 is a set screw that may be threaded into the lock pin bore 194.

Figure 3:
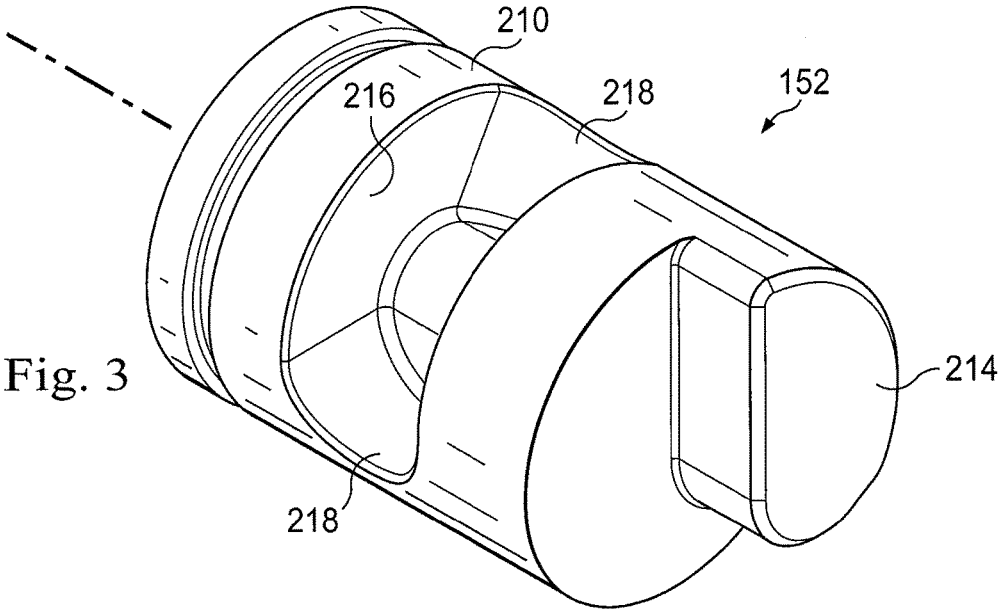
FIG. 3 is a perspective view of an example shaft portion of the locking pin assembly of FIG. 2.

The camshaft 152 is shown in FIGS. 2 and 3. It is sized and arranged to fit within the shaft main bore 184. The camshaft 152 may be rotated relative to the shaft portion 142 and may be rotated by a user to change the locking pin assembly 106 from the lock condition to the unlocked condition, and vice versa. The camshaft 152 includes an external surface 210, a tool interface 212 (FIG. 2) disposed at one end, and a cam 214 disposed at the opposing end. A snap-ring 153 or other type of ring may fit within a groove in the external surface 210 to secure the camshaft in the shaft main bore 184. In this embodiment, the tool interface is a hex shaped tool interface configured to receive a hex shaped tool, such as a hex key wrench. Other tool interfaces and tools could be used as would be apparent to one of ordinary skill in the art.

The external surface 210 of the camshaft 152 includes a lock groove 216 that circumferentially extends about the camshaft 152. Like the lock groove 186 on the shaft portion 142, the lock groove 216 extends only partially about the circumference of the camshaft 152. In this embodiment, the lock groove 216 may extend through an arc within a range of 90 and 340°. In some embodiments, the lock groove 216 may extend through an arc within the range of 90° to 180°. In some examples, the arc will extend about 120°. The lock groove 216 may cooperate with the cam rotation stop element 154 to limit the amount of rotation that can occur relative to the shaft portion 142. The lock groove 216 may have a radius or may be sized to receive the cam rotation stop element 154. Particularly, ends 218 of the lock groove 216 may be used as rotation stops to limit the rotation of the camshaft 152 relative to the shaft portion 142 and the cam rotation stop element 154.

The tool interface 212 is sized and arranged to receive a work tool (not shown) that may be handled by a user. The work tool may be inserted into the hex shaped tool interface 212 and turned to rotate the camshaft 152 to manipulate the locking pin assembly 106 from the locked position to the unlocked position and vice versa.

The cam 214 is a projection or boss extending from an end of the camshaft 152. The cam 214 is laterally offset relative to a center line of the camshaft 152. As will be described below, the cam 214 is disposed and arranged to interface with the cam flange 202 to radially displace the locking element 146 from a locked position to an unlocked position. In addition, the cam 214 may be rotated to allow the biasing element 148 to move the locking element 146 from an unlocked position to a locked position.

The cam rotation stop element 154 may be sized and shaped to fit through the stop element bore 143. When the camshaft 152 is disposed within the shaft main bore 184 of the shaft portion 142, the cam rotation stop element 154 may be aligned to fit within the lock groove 216 and prevent axial displacement of the camshaft 154 relative to the shaft portion 142, while permitting limited rotational displacement. Accordingly, the cam rotation stop element 154 may function to prevent axial movement, and also prevent rotation of the camshaft 152 beyond limits allowed by the ends of the partially circumferential lock groove 216.

The plug 156 is arranged to cover the opening of the locking bore 168. It may be a set screw that threads into an end of the locking bore 168, or other type of plug. In one embodiment, it is adhered over the opening to the locking bore 168 using an adhesive. Other attachment methods may be used and are contemplated.

Figure 4A:
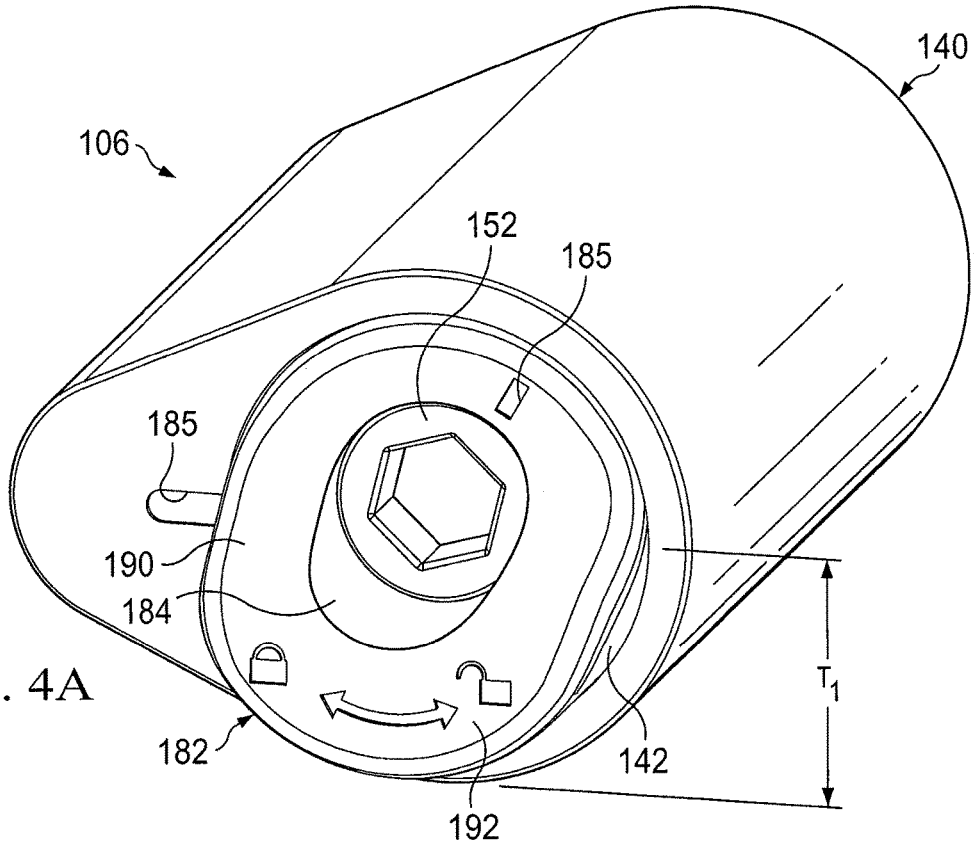
FIG. 4A is a perspective view of a locking pin assembly in an unlocked position.
Figure 4B:
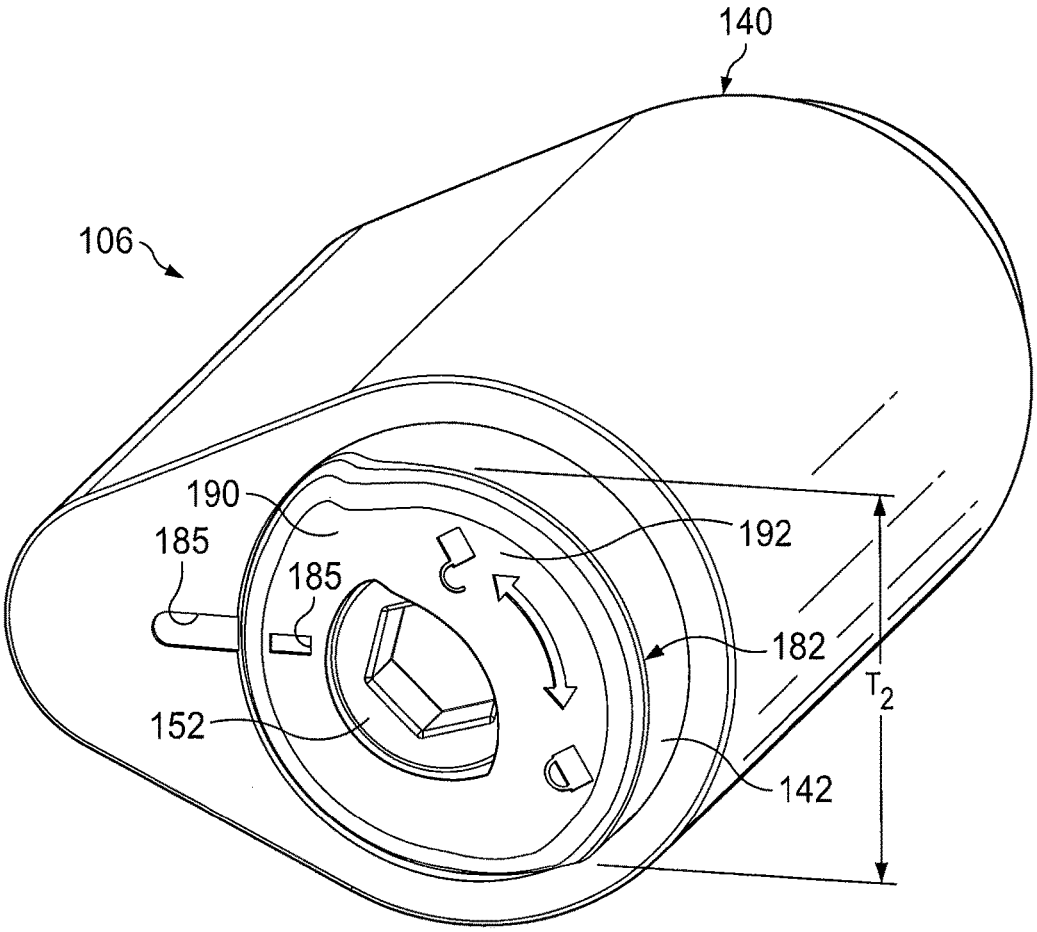
FIG. 4B is a perspective view of a locking pin assembly in a locked position.

FIGS. 4A and 4B show the locking pin assembly 106 in an unlocked position and a locked position, respectively. As can be seen, the shaft portion 142 is rotated when in the locked condition relative to the body portion 140. This rotation displaces the end tabs 182 from a position where the tabs have a minimal vertical thickness T1 to a position where the end tabs have a much greater vertical thickness T2. Referring to FIG. 1, when in the unlocked position, the end tabs 182 are arranged to pass through the recesses 132 in the tooth point 104 until they are aligned with the connector openings 128. After rotating to the locked position, the vertical tabs mechanically interfere with structure on the tooth point 104 and prevent its removal from the adapter 102. In the embodiment shown, reference indicators 185 are formed, marked, edged, or otherwise provided on both the body portion 140 and ends of the shaft portion 142. When the reference indicators 185 are aligned, as shown in FIG. 4B, the locking pin assembly 106 may be in the locked position. When the reference indicators 185 are misaligned, as shown in FIG. 4A, the locking pin assembly 106 may not be in the locked position. This may provide a user with visual indication of when the locking pin assembly 106 is properly in the locked position.

Figure 5A:
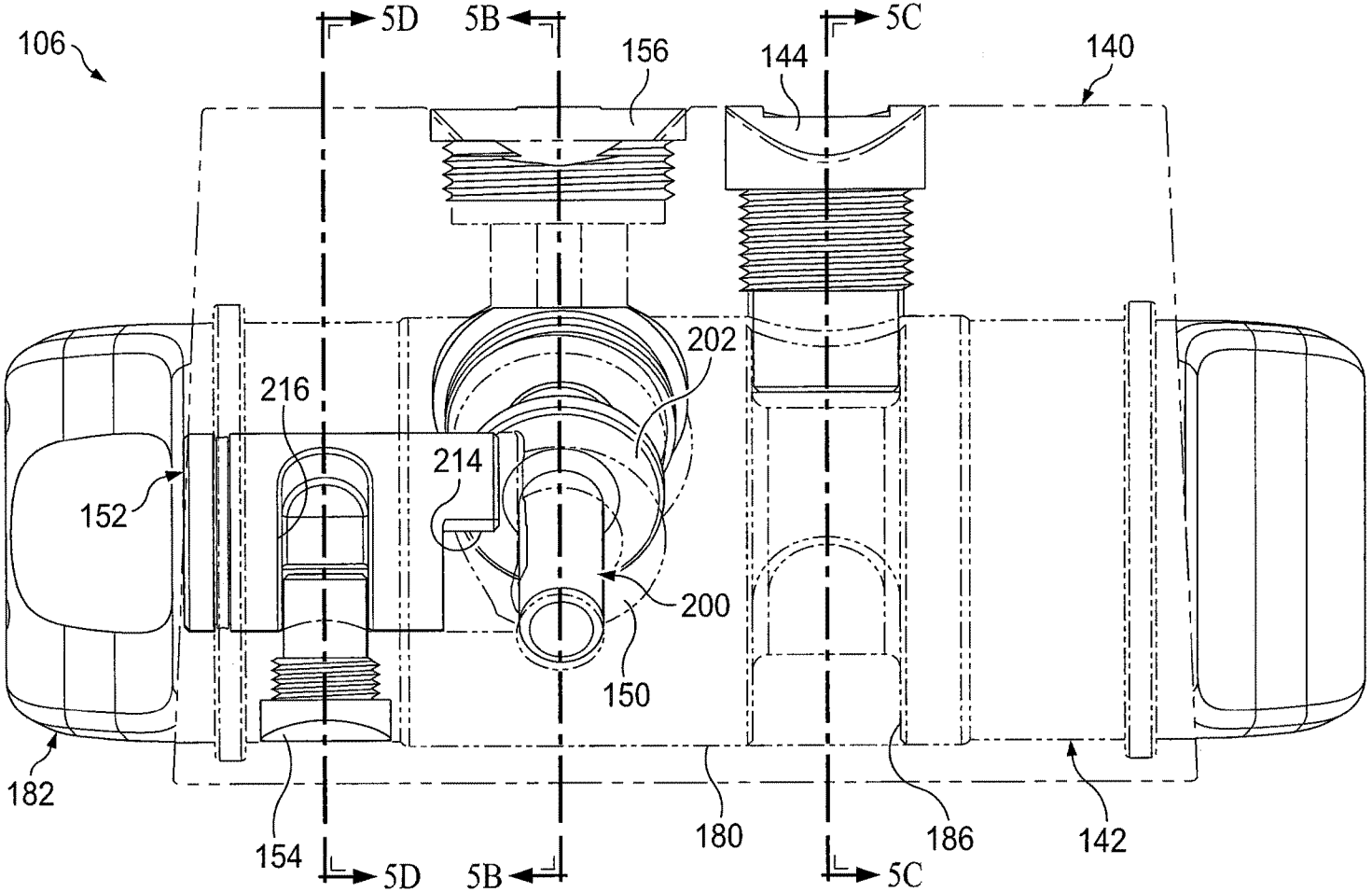
FIG. 5A is a partially transparent plan view of the locking pin assembly in an unlocked position.
Figure 5B:
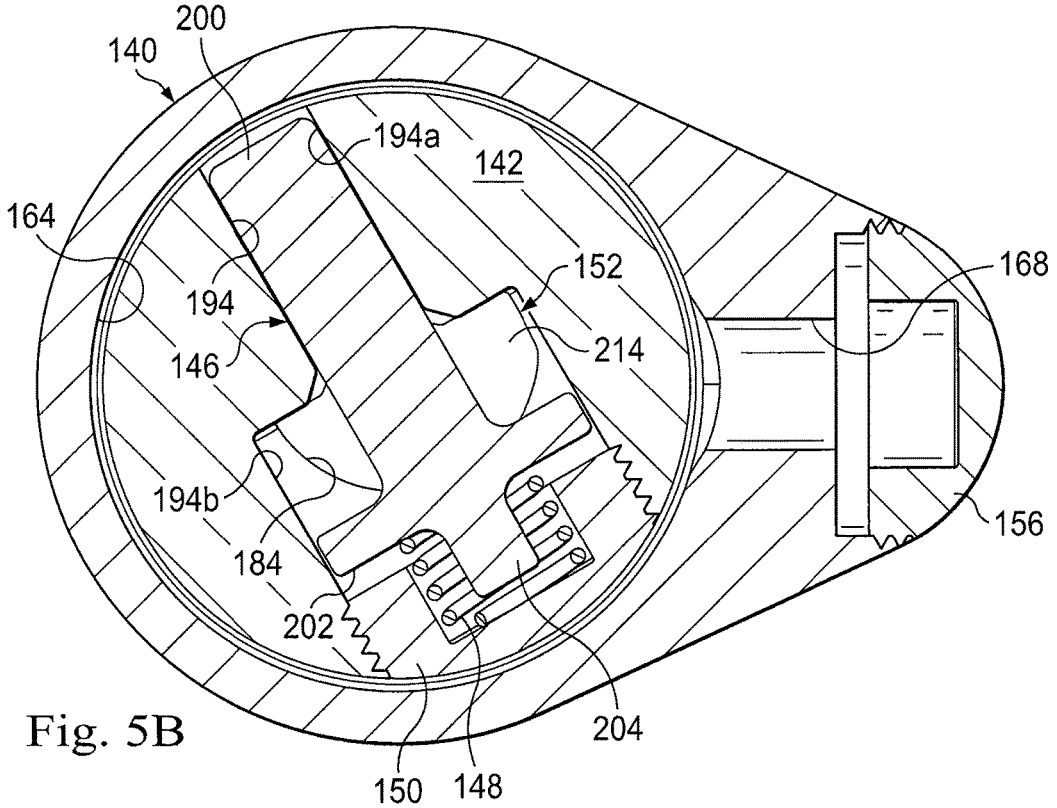
FIG. 5B is a cross-sectional view taken along lines 5B-5B of FIG. 5A through a locking element of the locking pin assembly in an unlocked position.
Figure 5C:
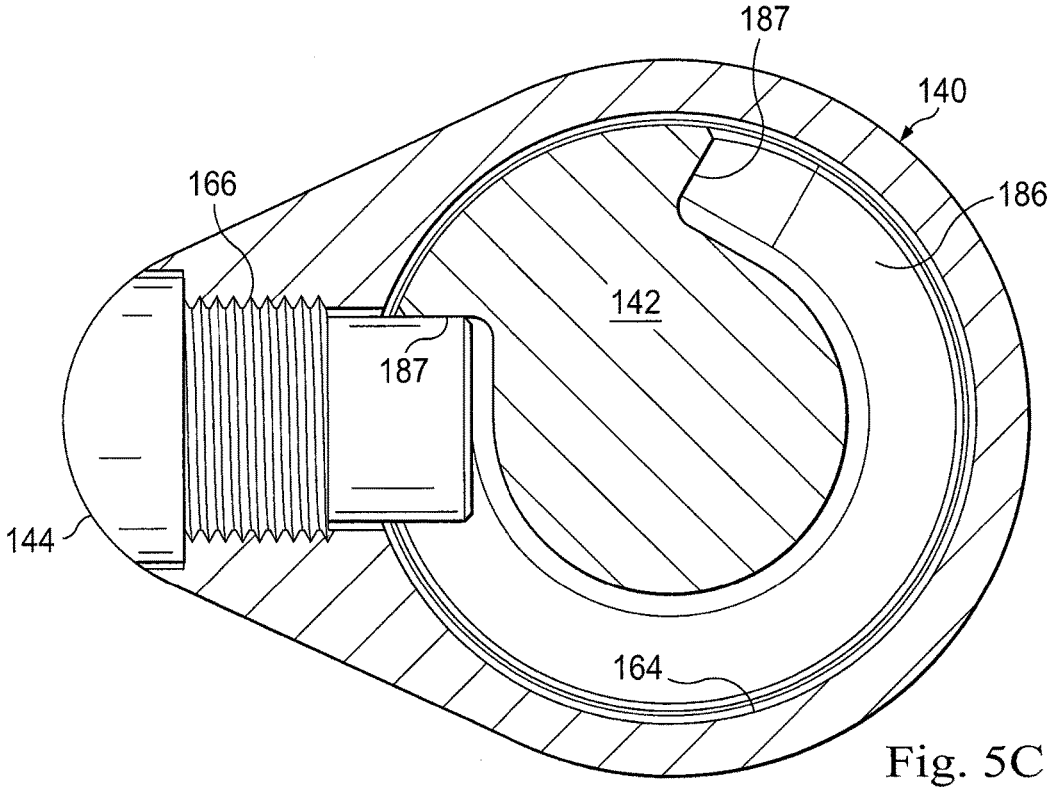
FIG. 5C is a cross-sectional view taken along lines 5C-5C of FIG. 5A through a shaft rotation stop element of the locking pin assembly in an unlocked position.
Figure 5D:
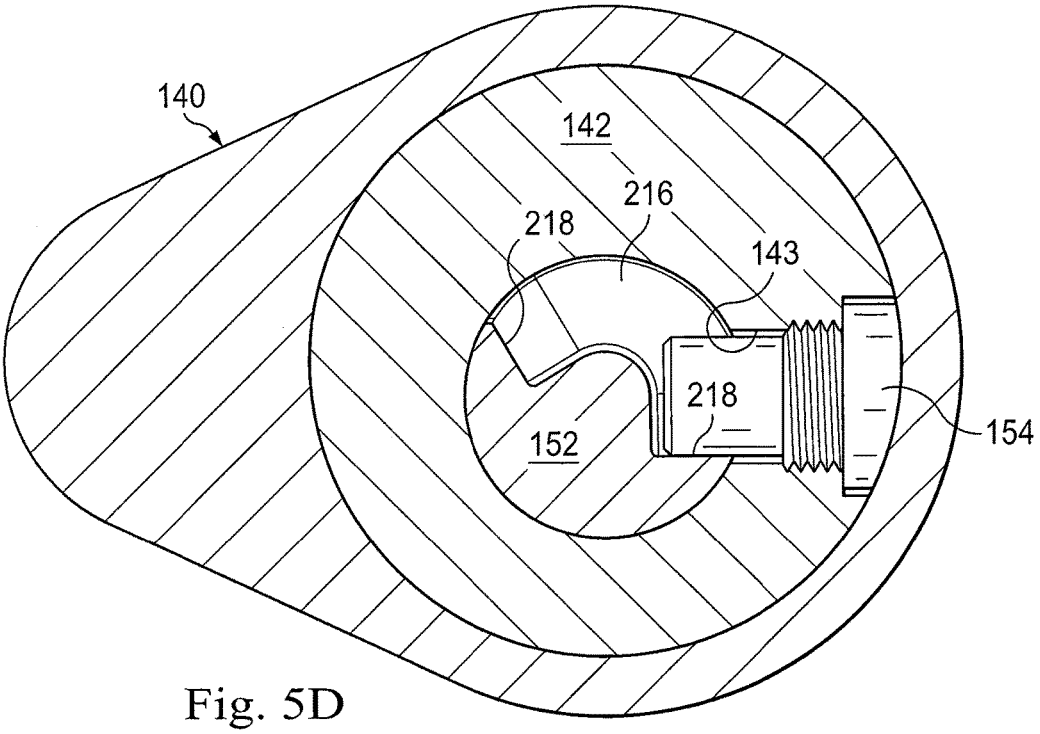
FIG. 5D is a cross-sectional view taken along lines 5D-5D of FIG. 5A through a cam rotation stop element of the locking pin assembly in an unlocked position.
Figure 5E:
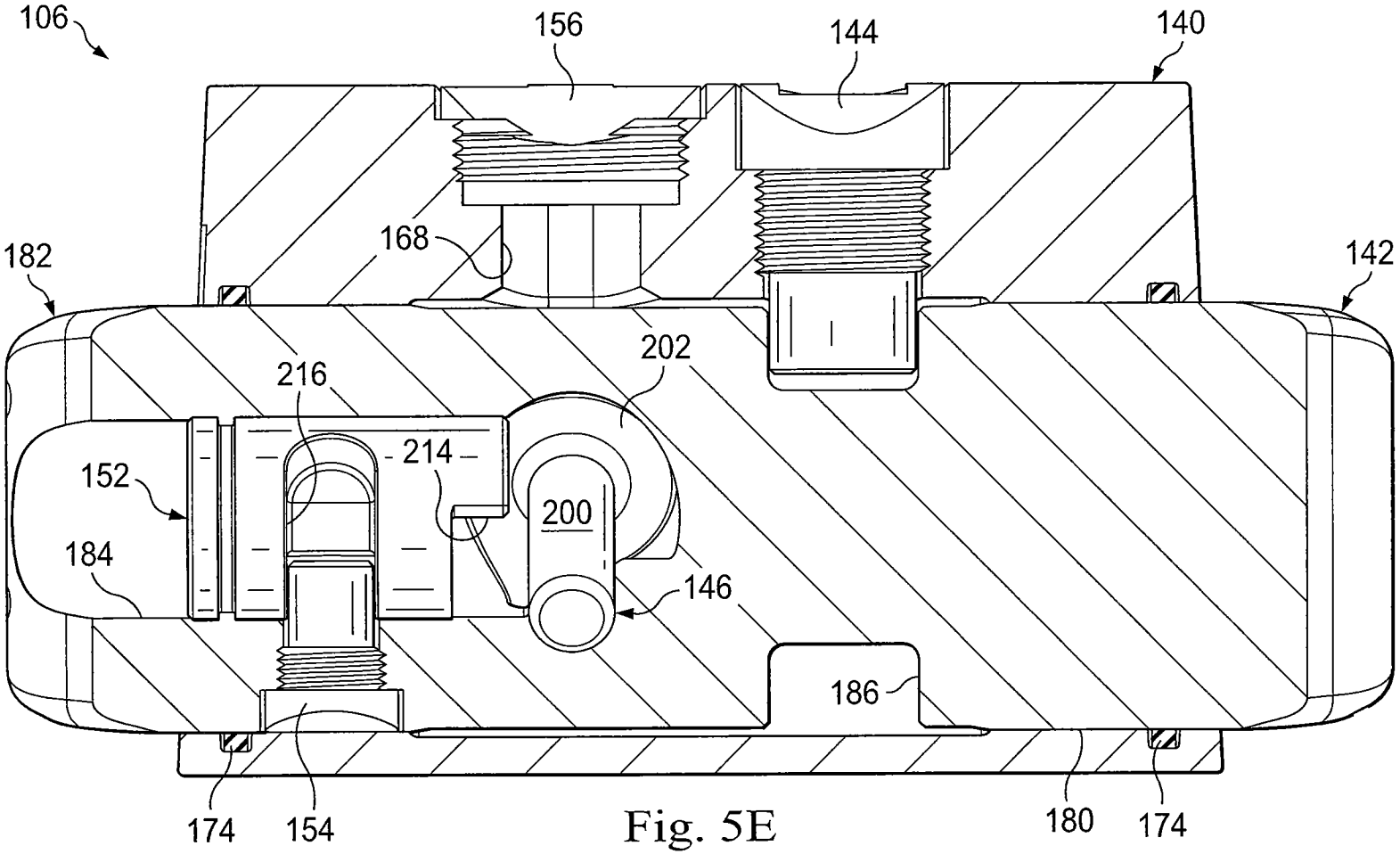
FIG. 5E is a partial cross-sectional plan view of the locking pin assembly in an unlocked position.

FIGS. 5A through 5E show the locking pin assembly 106 when arranged in the unlocked condition. FIG. 6A through 6E show the locking pin assembly 106 when arranged in the locked condition. FIG. 5A shows a plan view of the locking pin assembly 106 in the unlocked position with the body portion and the shaft portion marked as transparent to more clearly show the other components. FIGS. 5B through 5E show the locking pin assembly in different cross-sectional views with solid lines. FIG. 5B shows a cross-section taken along lines 5B-5B in FIG. 5A through the locking element 146. FIG. 5C shows a cross-section taken along lines 5C-5C in FIG. 5A through the shaft rotation stop element 144 and the lock groove 186. FIG. 5D shows a cross-section taken along lines 5C-5C in FIG. 5A through the cam rotation stop element 154 and the lock groove 216. FIG. 5E shows a partial cross-section taken axially through only the body portion 140 and shaft portion 142 of the locking pin assembly 106.

Referring to FIGS. 5A through 5E, when in the unlocked position, the shaft portion 142 may be rotated to a stop limit in one direction, but may be rotated in the other direction. This can be best seen in FIG. 5C. FIG. 5C shows a cross-section taken through the shaft portion 142 and the shaft rotation stop element 144. In the exemplary embodiment shown, the lock groove 186 extends only partially around the circumference of the shaft portion 142. Accordingly, with the shaft rotation stop element 144 in the lock groove 186, the amount of rotation of the shaft portion 142 is limited. Here, the ends 187 of the groove 186 abut against the shaft rotation stop element 144 and prevent further rotation.

In FIG. 5B, the locking element 146 is disposed completely within the lock pin bore 194. As can be seen, the lock pin bore 194 includes the smaller diameter portion 194*a* having an opening disposed to face the inner wall of the main bore 164 of the body portion 140. In some embodiments, the inner wall includes a depression into which the locking element 146 may project to form a detent-like tactile feel to a user. The cam 214 of the camshaft 152 is disposed in the shaft main bore 184 and is in contact with the cam flange 202. In the unlocked condition, the locking element 146 is retracted by the cam 214 against the force of the biasing element 148. Here, the biasing element 148 is a coil spring compressed between the backstop 150 and the biasing element interfacing portion 204.

As can be seen in FIG. 5D, the camshaft 152 rotation relative to the shaft portion 142 is limited in a manner similar to that described with reference to the lock groove 186 and the shaft rotation stop element 144. The camshaft 152 includes the lock groove 216, and the cam rotation stop element 154 extends through the locking bore 143 and into the lock groove 216. The camshaft 152, therefore, may be limited in its rotation to less than 360° by virtue of the lock groove 216 extending less than completely about the circumference of the camshaft 152. The ends 218 of the lock groove 216 come into contact with the cam rotation stop element 154 to limit the range of motion.

FIG. 5E shows a partial cross-sectional view of the locking pin assembly 106. In this exemplary embodiment, the body portion 140 and the shaft portion 142 are shown in cross-section. Accordingly, the relationship between the lock groove 186 and the shaft rotation stop element 144 and between the cam lock groove 216 and the cam rotation stop element 154 are more particularly shown. In addition, the placement of the cam 214 relative to the cam flange 202 is also shown.

Figure 6A:
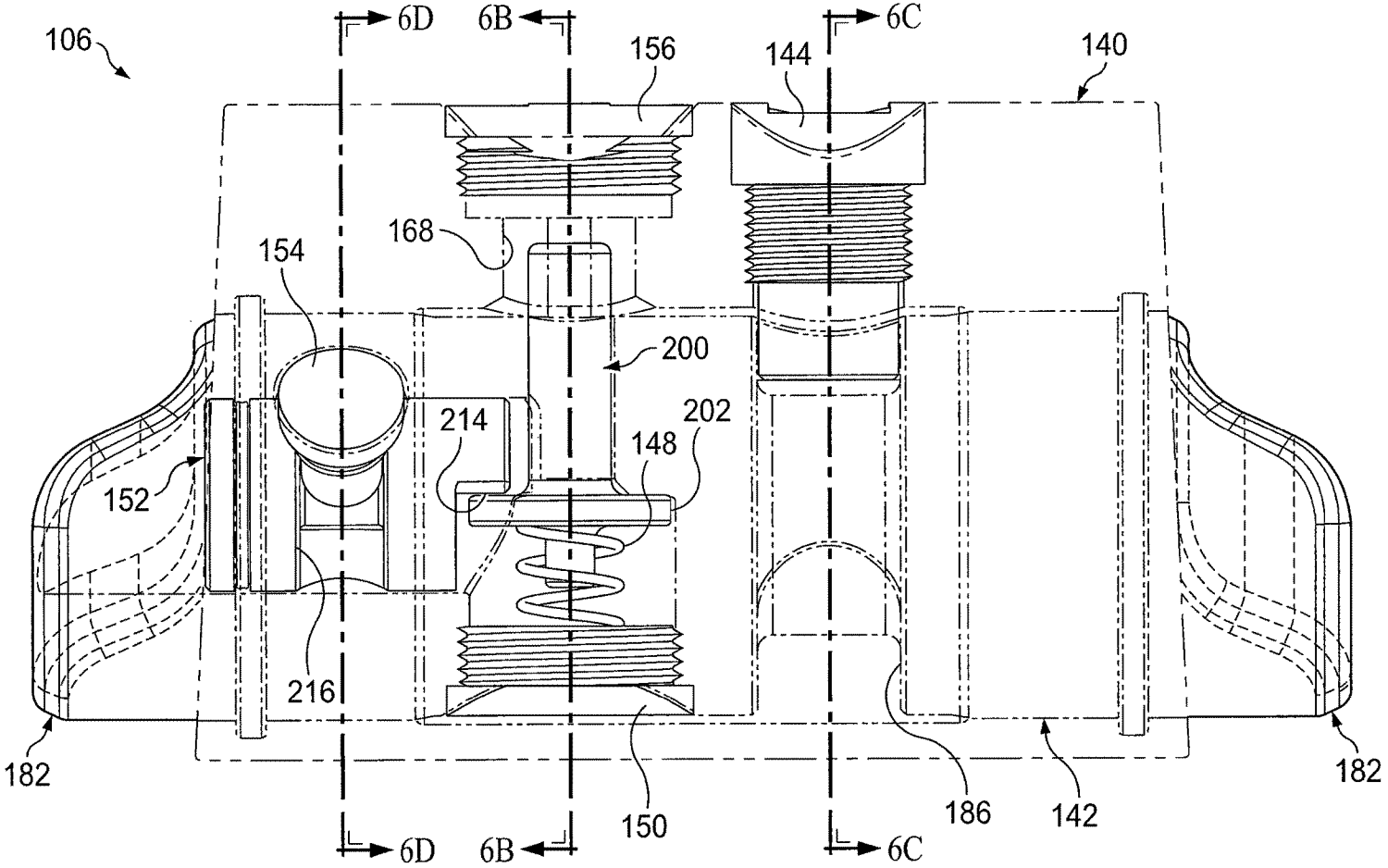
FIG. 6A is a partially transparent plan view of the locking pin assembly in a locked position.
Figure 6B:
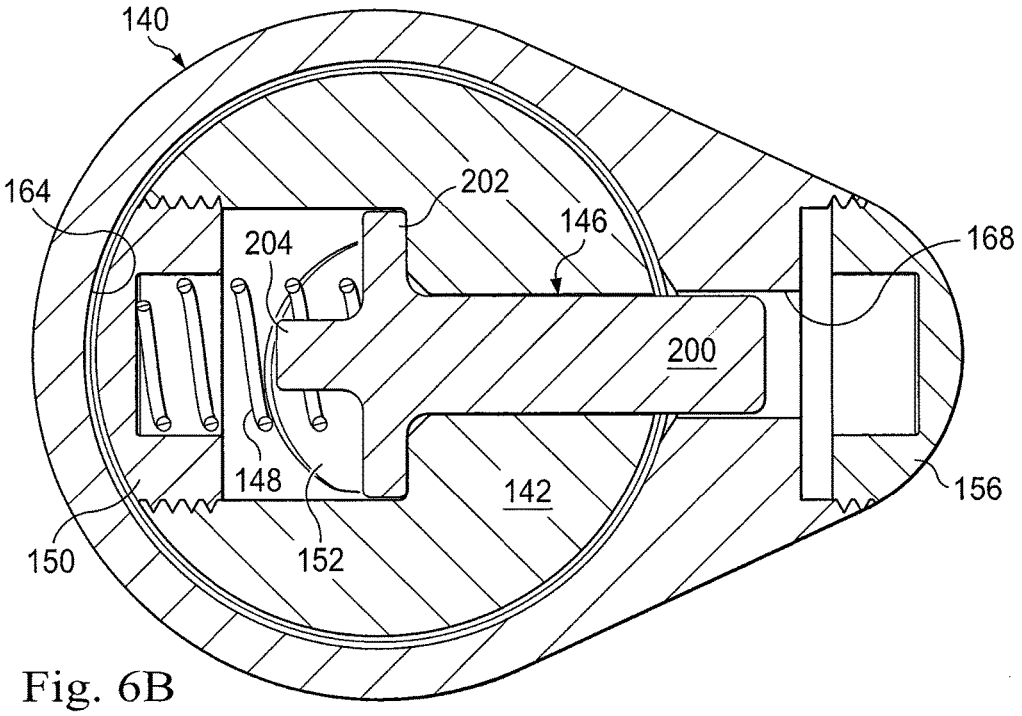
FIG. 6B is a cross-sectional view taken along lines 6B-6B of FIG. 6A through the locking element of the locking pin assembly in a locked position.
Figure 6C:
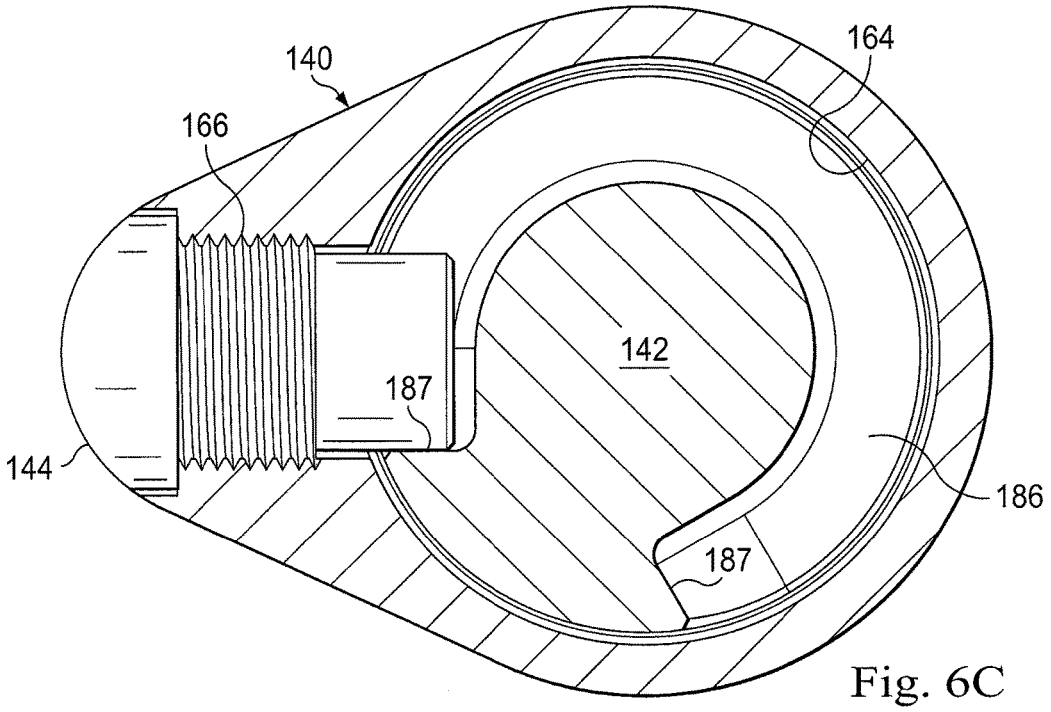
FIG. 6C is a cross-sectional view taken along lines 6C-6C of FIG. 6A through the shaft rotation stop element of the locking pin assembly in a locked position.
Figure 6D:
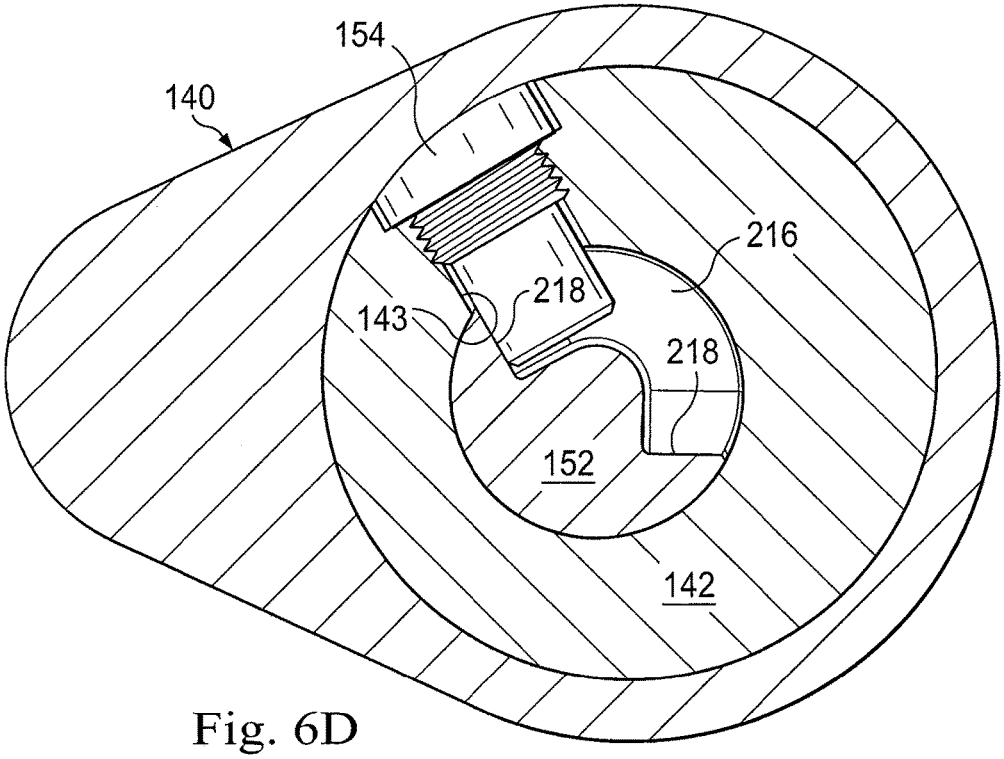
FIG. 6D is a cross-sectional view taken along lines 6D-6D of FIG. 6A through the cam rotation stop element of the locking pin assembly in a locked position.
Figure 6E:
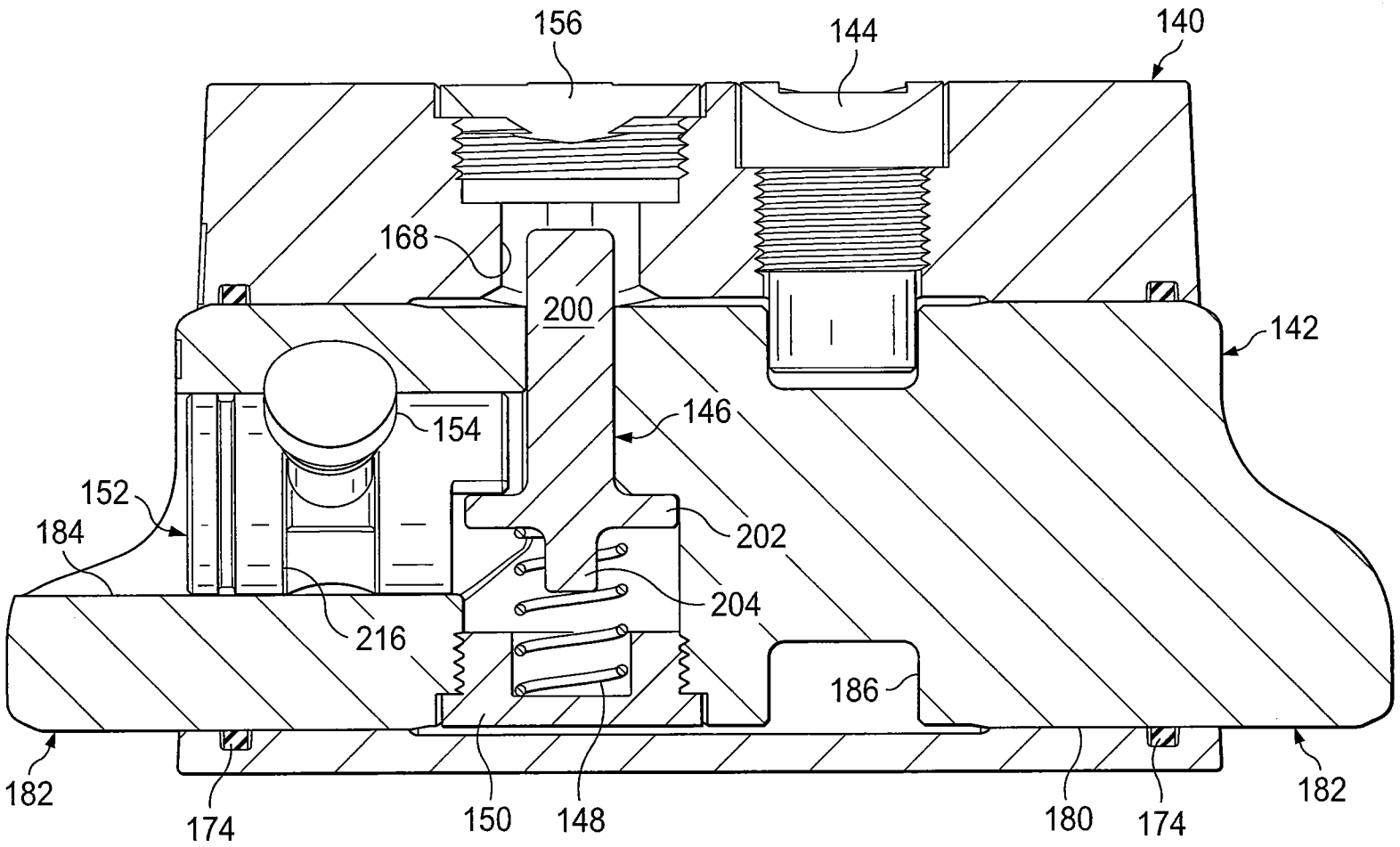
FIG. 6E is a partial cross-sectional plan view of the locking pin assembly in a locked position.

As indicated above, FIGS. 6A through 6E show the locking pin assembly 106 when arranged in the locked condition. FIG. 6A shows a plan view of the locking pin assembly 106 in the locked position with the body portion and the shaft portion marked as transparent to more clearly show the other components. FIGS. 6B through 6E show the locking pin assembly in different cross-sectional views. FIG. 6B shows a cross-section taken along lines 6B-6B in FIG. 6A through the locking element 146. FIG. 6C shows a cross-section taken along lines 6C-6C in FIG. 6A through the shaft rotation stop element 144 and the lock groove 186. FIG. 6D shows a cross-section taken along lines 6D-6D in FIG. 6A through the cam rotation stop element 154 and the lock groove 216. FIG. 6E shows a partial cross-section taken axially through only the body portion 140 and the shaft portion 142 of the locking pin assembly 106.

Referring to FIGS. 6A through 6E, when in the locked position, the shaft portion 142 has been rotated until the locking element 146 projects into the locking bore 168 of the body portion 140 and prevents further rotation in either opposing direction.

In FIG. 6B, the shaft portion 142 is rotated from the position shown in FIG. 5B until the locking element 146 is aligned with the locking bore 168 in the body portion 140. Rather than being substantially completely disposed within the lock pin bore 194, in this alignment, the cam 214 is displaced away from the cam flange 202 and the biasing element acts on the locking element 146 to displace the cylinder portion 200 out of the lock pin bore 194 and into the locking bore 168.

It should be noted that the locking element 146 also has a different position relative to the cam 214 of the camshaft 152. In this position, the cam 214 is not acting to maintain the locking element 146 within the lock pin bore 194. Instead, the cam 214 is rotated out of engagement with the cam flange 202. As such, the biasing element 148 operates to bias the locking element 146 out of the lock pin bore 194 and into the locking bore 168 of the body portion 140. With the locking element projecting into the locking bore 168, inadvertent movement or rotation of the shaft portion 142 in either rotational direction may be inhibited. In some embodiments, the cam flange 202 may reengage when the locking element pops radially outwardly to the locked position.

As can be seen in FIG. 6D, the angle of rotation of the camshaft 152 relative to the shaft portion 142 is limited in a manner similar to that described with reference to the lock groove 186 and the shaft rotation stop element 144. The camshaft 152 includes the lock groove 216, and the cam rotation stop element 154 is disposed within the lock groove 216. The camshaft 152, therefore, may be limited in its rotation to less than 360° by virtue of the lock groove 216 extending less than completely about the circumference of the camshaft 152. FIG. 6E shows a partial cross-sectional view of the locking pin assembly 106. FIG. 6E shows the locking element 146 projecting into the locking bore 168.

Figure 7A:
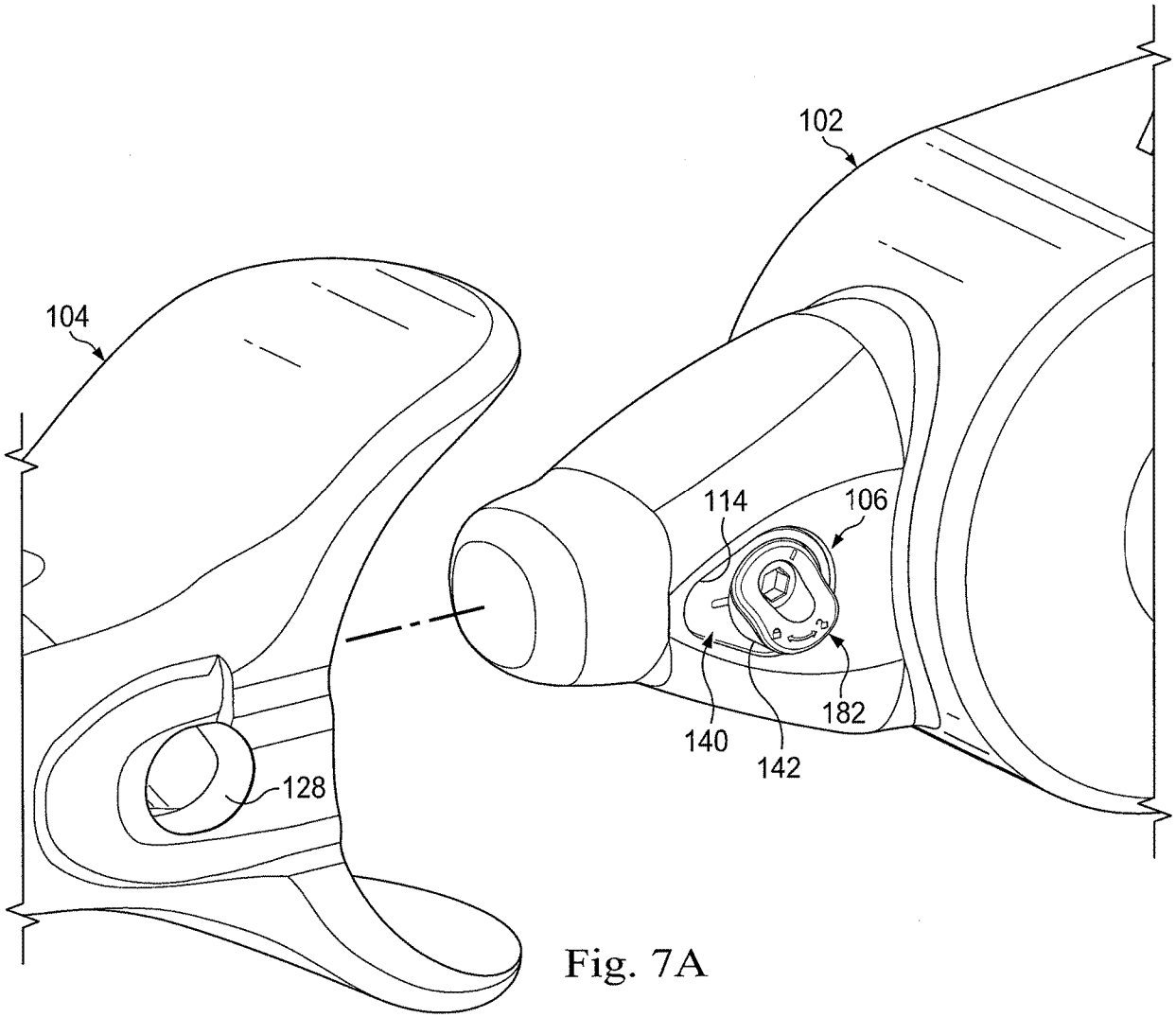
FIG. 7A is a perspective view of an excavating tooth assembly with the locking pin assembly disposed in an adapter in an unlocked position to receive a wear member.

An exemplary process for installing the tooth point 104 to the adapter 102 will be described with reference to FIGS. 7A through 7E, and with reference to other Figures already described herein. Referring first to FIG. 7A, the locking pin assembly 106 in its fully assembled state is disposed within the connector opening 114 of the adapter 102. As described herein, the locking pin assembly 106 is prevented from rotating within the connector opening 114 by its noncircular shape. The locking pin assembly 106 is oriented in the unlocked position because the end tabs 182 are disposed to have a minimal vertical height or vertical thickness T1.

With the locking pin assembly 106 in place in the adapter 102, the tooth point 104 is introduced over the adapter 102. The end tabs 182 enter into the recesses 132 (FIG. 1) formed in the interior of the tooth point 104 until the tooth point is seated on the adapter 102 and/or the locking pin assembly 106 is aligned with the connector openings 128.

Figure 7B:
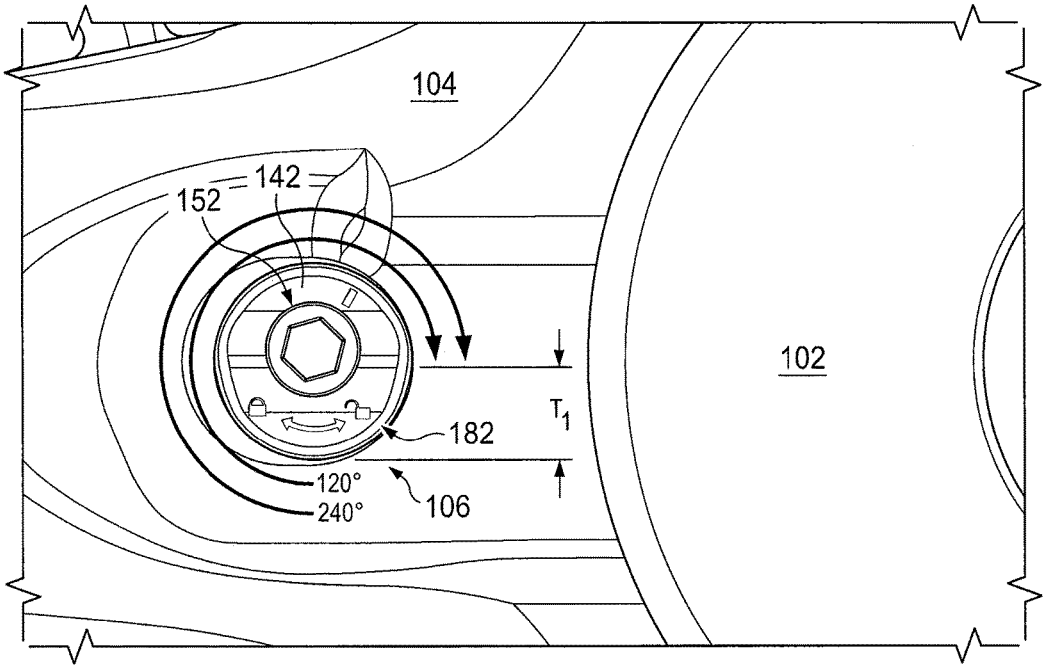
FIG. 7B shows the wear member assembled on the adapter with the locking pin assembly in an unlocked position and shows the movement required to change the locking pin assembly from the unlocked position to a locked position.

With the locking pin assembly 106 aligned with the connector openings 128, a user may access the hex shaped tool interface 212 of the camshaft 152. Using an appropriate tool, the user may rotate first the camshaft 152 and next the shaft portion 142. Referring to FIG. 7B and in the exemplary implementation shown, the camshaft 152 is rotated 120°, and then the shaft portion 142 is rotated 240° to change the locking pin assembly from the unlocked condition to the locked condition. These can change depending on the length of the grooves 186, 216 or the thickness of the rotational stops. In some embodiments, a user may rotate the camshaft through a range of motion in a range between 1 and 180 degrees, and may rotate the shaft portion through a range of motion in a range between 90 and 300 degrees.

As indicated above, FIGS. 5B, 5C, and 5D show cross-sectional views of the locking pin assembly 106 in the unlocked condition. With reference to FIG. 5A, when a user rotates the camshaft 152 with a tool, the cam 214 first rotates up to 120°, which moves the cam 214 away from the cam flange 202 of the locking element 146. During this movement, the camshaft 152 rotates relative to the shaft portion 140 and the cam rotation stop 154. In this state, however, the inner wall of the body portion 140 prevents the locking element 146 from extending beyond a minimal amount from the lock pin bore 194. However, since the cam 214 is removed from the cam flange 202, only the inner wall of the body portion 140 prevents the locking element 146 from substantially extending out of the lock pin bore 194. The camshaft 152 rotates so long as the lock groove 216 is permitted by the cam rotation stop element 154. When the end 218 of the lock groove 216 abuts against the cam rotation stop element 154, all relative movement of the camshaft 152 to the shaft portion 142 in the locking direction is prevented. Accordingly, any further rotational load applied by a user to rotate the camshaft 152 is transferred by the cam rotation stop element 154 to the shaft portion 142. As such, in this embodiment, when the camshaft 152 reaches its rotational limit, torsional forces on the camshaft 152 are transferred to the shaft portion 142, and the shaft portion 142 begins to rotate.

In this example, the shaft portion 142 rotates 240° from the position shown in FIG. 5C toward the position shown in FIG. 6C. As it does so, the locking element 146 slides along the inner wall of the main bore 164 until the locking element 146 is aligned with the locking bore 168. When the locking element 146 aligns with the locking bore 168 as shown in FIG. 6B, the locking element 146 pops or clicks into the locking bore 168 under the spring force of the biasing element 148. This may provide an audible indication to the user that the locking pin assembly is properly seated and in place.

Figure 7C:
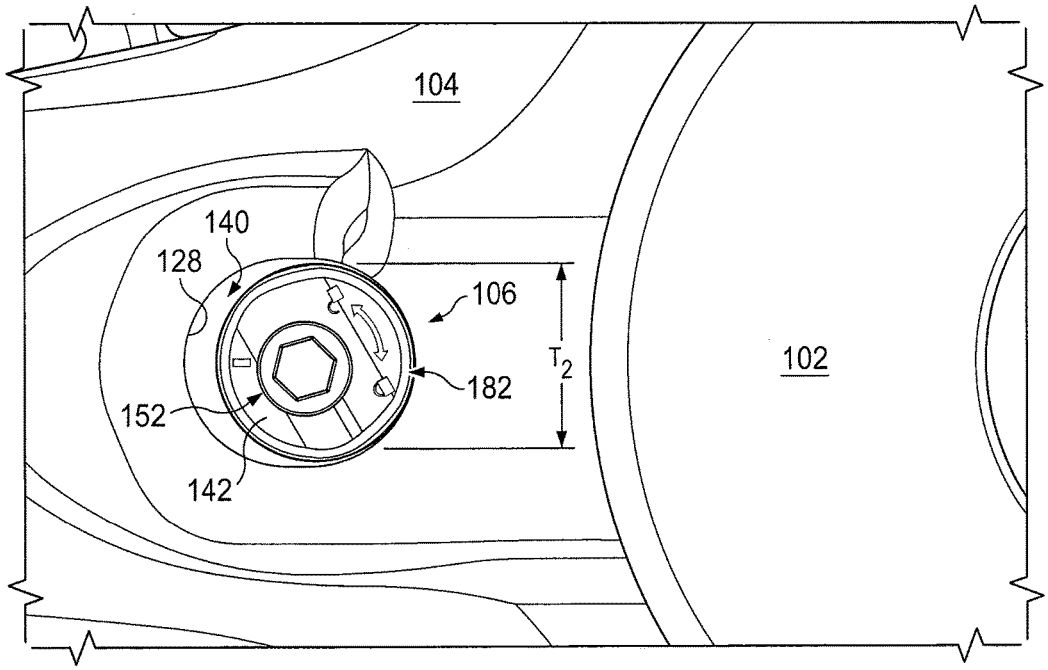
FIG. 7C shows the wear member assembled on the adapter with the locking pin assembly in a locked position.

FIG. 7C shows the locking pin assembly 106 in the locked position. Here, the end tabs 182 of the shaft portion 142 are rotated to have the vertical thickness T2. Although described as having vertical thicknesses T1 and T2, it should be noted that all the thicknesses described herein may be measured relative to the insertion direction of the tooth point 104 onto the adapter 102 or relative to the height or position of the insertion recesses 132. With the locking pin assembly 106 in the locked position, the end tabs 182 are no longer aligned with the recesses 132 (FIG. 1) in the tooth point 104. Because of the misalignment, the end tabs 182 abut against inner surfaces of the connector openings 114 and prevent removal of the tooth point 104 from the adapter 102.

If the tooth 104 becomes worn, a user may desire to remove it from the adapter 102. In this embodiment, to do this, the shaft portion 142 must be rotated so that the end tabs 182 align with the recesses 132 in the tooth 104. The locking pin assembly 106 does this by first, rotating the camshaft 152 through a first range of motion to radially withdraw the locking element 146 and then second, rotating the shaft portion 142.

Figure 7D:
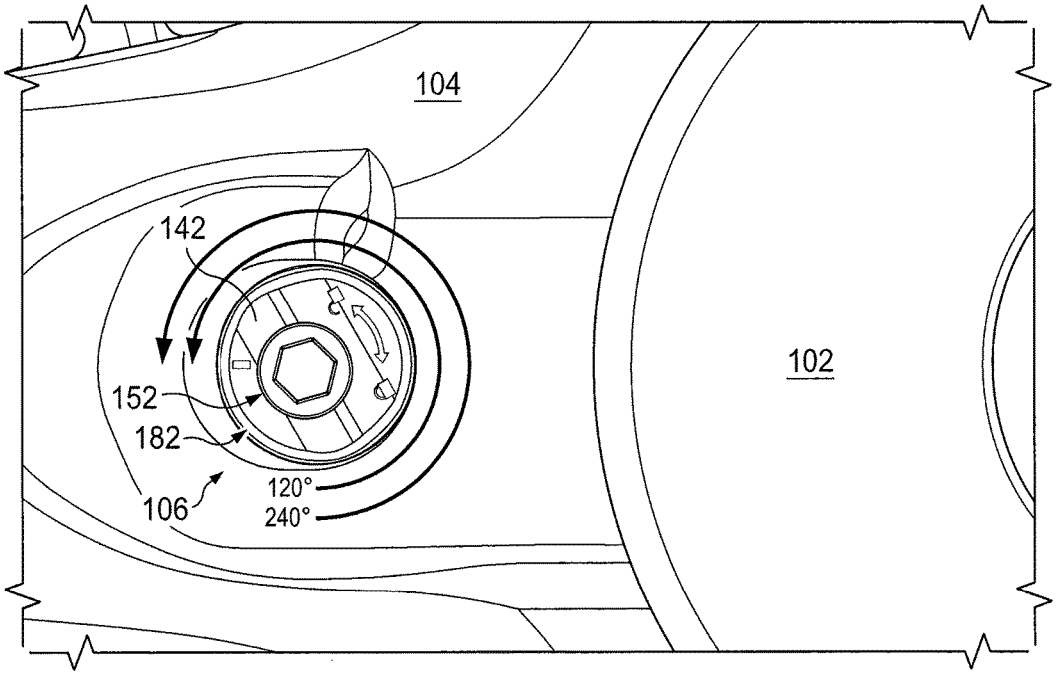
FIG. 7D shows the wear member assembled on the adapter with the locking pin assembly in the locked position and the movement required to change the locking pin assembly from the locked position to the unlocked position.
Figure 7E:
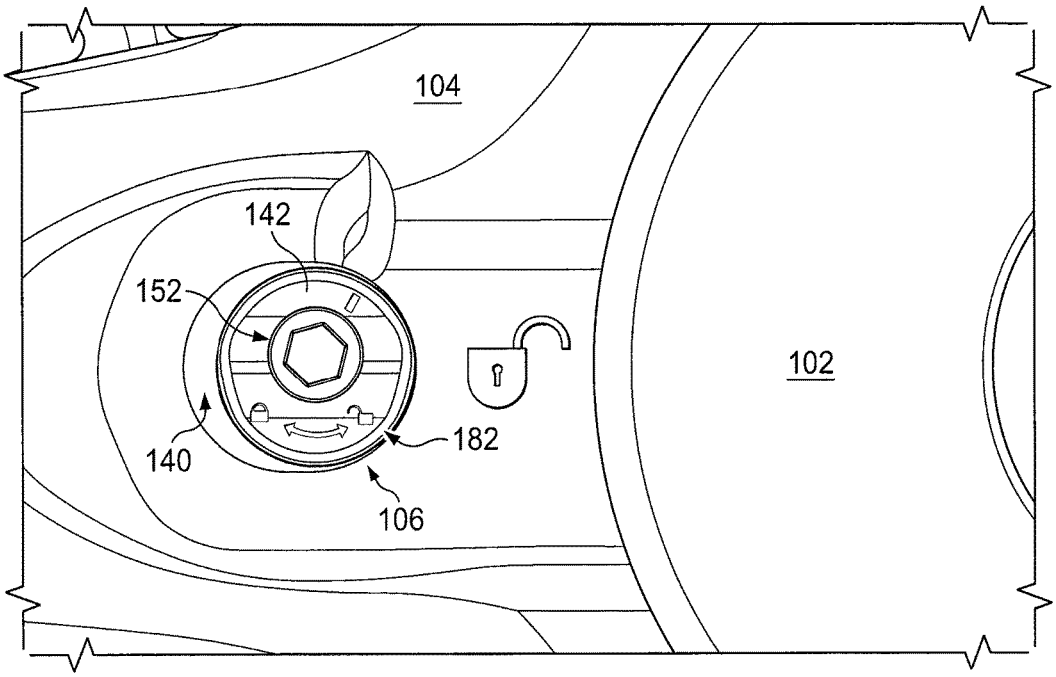
FIG. 7E shows the wear member assembled on the adapter with the locking pin assembly in the unlocked position.

Turning to FIG. 7D, the user may insert a tool and rotate the camshaft 152 with the tool. As the camshaft 152 rotates, the cam 214 acts on the cam flange 202 against the force of the biasing member 148. With the cam 214 applying a retracting load on the cam flange 202 of the locking element 146, the cylinder portion 200 begins to retract from the locking bore 168 in the body portion 140. At the same time, the camshaft 152 rotates relative to the cam rotation stop 154. When the locking element 146 is clear of the locking bore 168, the end 218 of the lock groove 216 in the camshaft 152 will engage the cam rotation stop 154. As can be seen in FIG. 7D, this may occur after a rotation of about 120° of the camshaft 152. Accordingly, any further rotational force applied on the camshaft 152 results in a rotational force on the shaft portion 142. In this embodiment, an additional rotation of 240° will rotate the shaft portion 142 from the position shown in FIG. 7D to the unlocked position shown in FIG. 7E. In this position, the end tabs 182 of the shaft portion 140 are aligned to have a minimal thickness that may fit through the recesses 132 (FIG. 1) formed in the tooth 104.

FIGS. 8A, 8B, 9A, 9B, 9C, 10A, 10B, 10C, 11A, 11B, and 11C show another embodiment of a locking pin assembly, referenced herein by the numeral 406. The locking pin assembly 406 includes many of the same features as the locking pin assembly 106 described above. Therefore, the description of the locking pin assembly 106 may be applicable to the elements of the locking pin assembly 406. For ease of understanding, the components of the locking pin assembly 106 will not all be re-described, as the above description should be sufficient for understanding by one of ordinary skill in the art. In addition, for ease of understanding and to avoid repetition, some features of the locking pin assembly 406 are identified by the same reference numerals as similar features on the locking pin assembly 106. The locking pin assembly 406 differs from the locking pin assembly 106 by being accessed from an opposite side and by having a different rotational range to move the locking pin assembly from a locked to an unlocked position and vice versa.

Figure 8A:
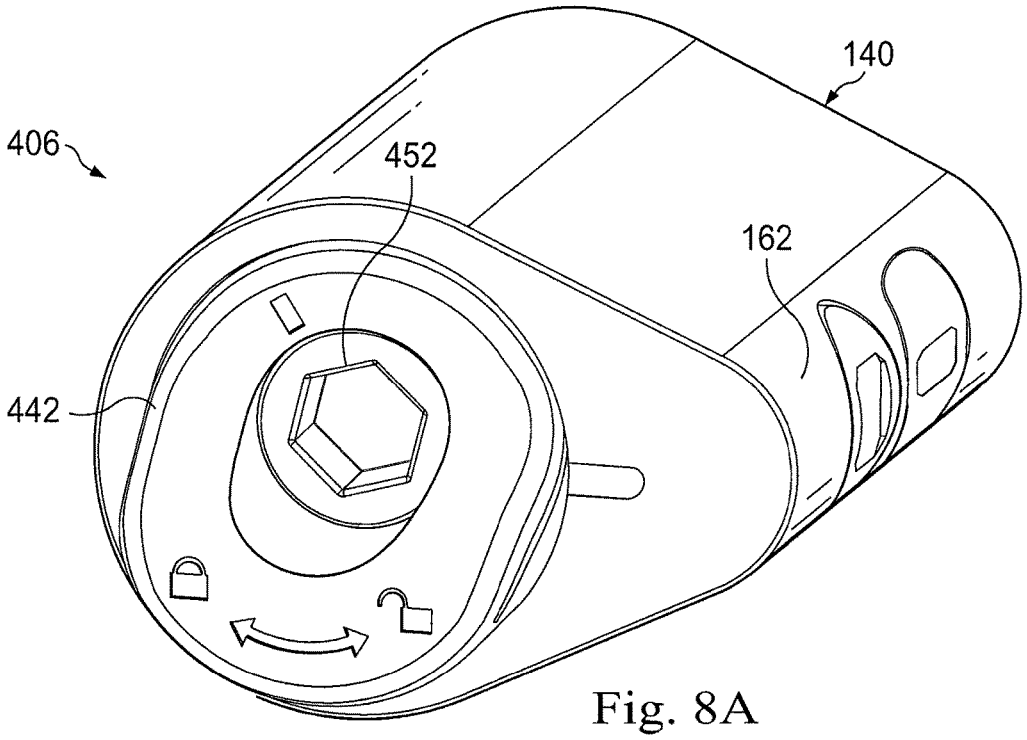
FIG. 8A is a perspective view of a locking pin assembly in an unlocked position.
Figure 8B:
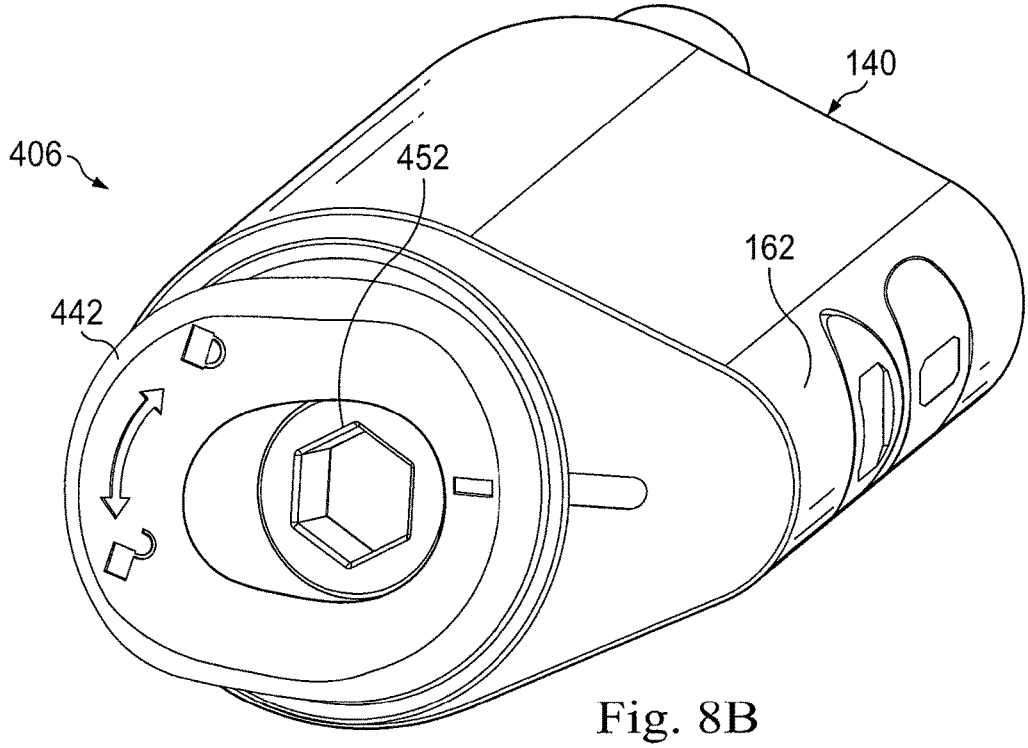
FIG. 8B is a perspective view of a locking pin assembly in a locked position.

FIGS. 8A and 8B show the locking pin assembly 406 in an unlocked position and a locked position, respectively. The locking pin assembly 406 includes the body portion 140, a shaft portion 442, and a camshaft 452. The leading portion 162 of the body portion 140, in this example implementation, may still face the leading nose of the adapter 102 and the tooth 104. Accordingly, the locking pin assembly 406 may be arranged to be accessed from a left side of the adapter and tooth point rather than the right side, as is the locking pin assembly 106. However, it should be understood that the locking pin assemblies described herein may be manufactured for access from either or both sides. As described above, rotation of the shaft portion 442 displaces end tabs 482 from a position where the tabs have minimal vertical thickness to a position where the tabs have a much greater vertical thickness in order to facilitate placing the tooth point 104 over the end tabs and securing the tooth point 104 to the adapter 102.

Figure 9A:
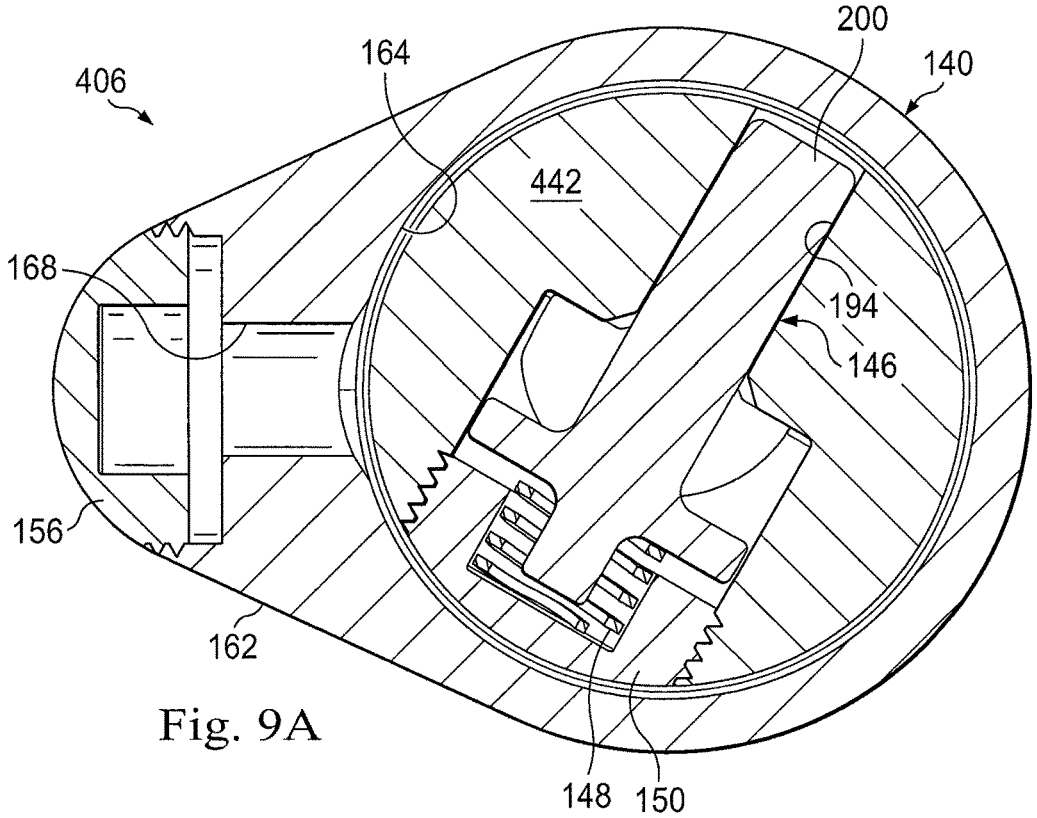
FIG. 9A is a cross-sectional view similar to the view shown in FIG. 5B through a locking element of a locking pin assembly in an unlocked position.
Figure 9B:
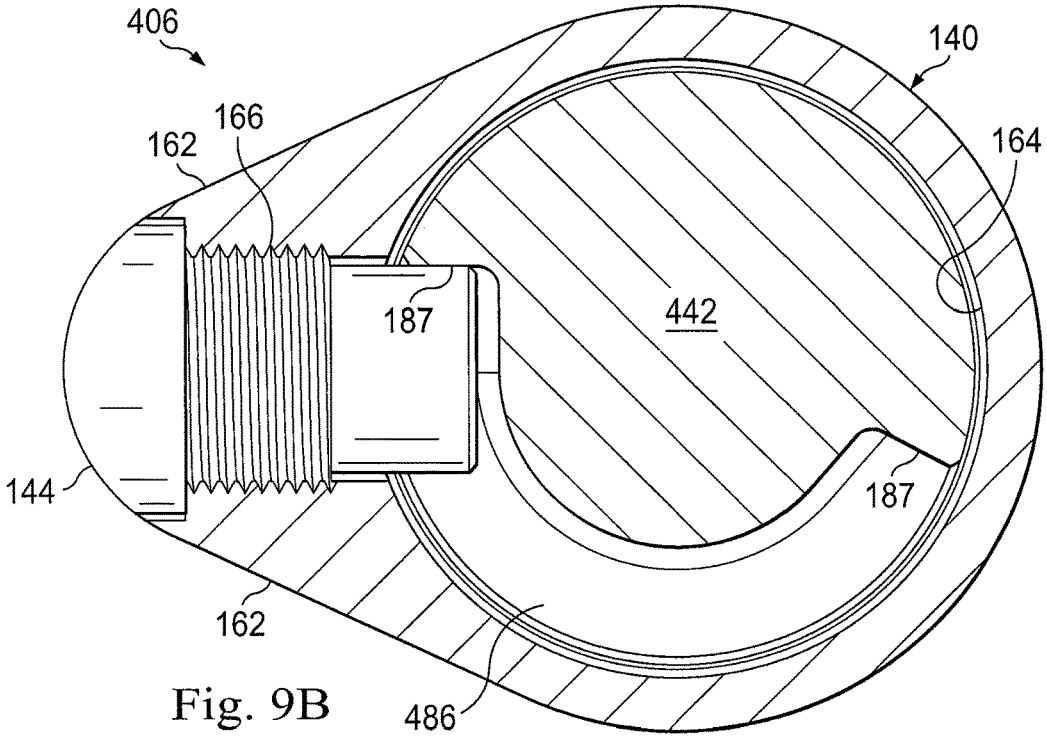
FIG. 9B is a cross-sectional view similar to the view shown in FIG. 5C through a shaft rotation stop element of a locking pin assembly in an unlocked position.
Figure 9C:
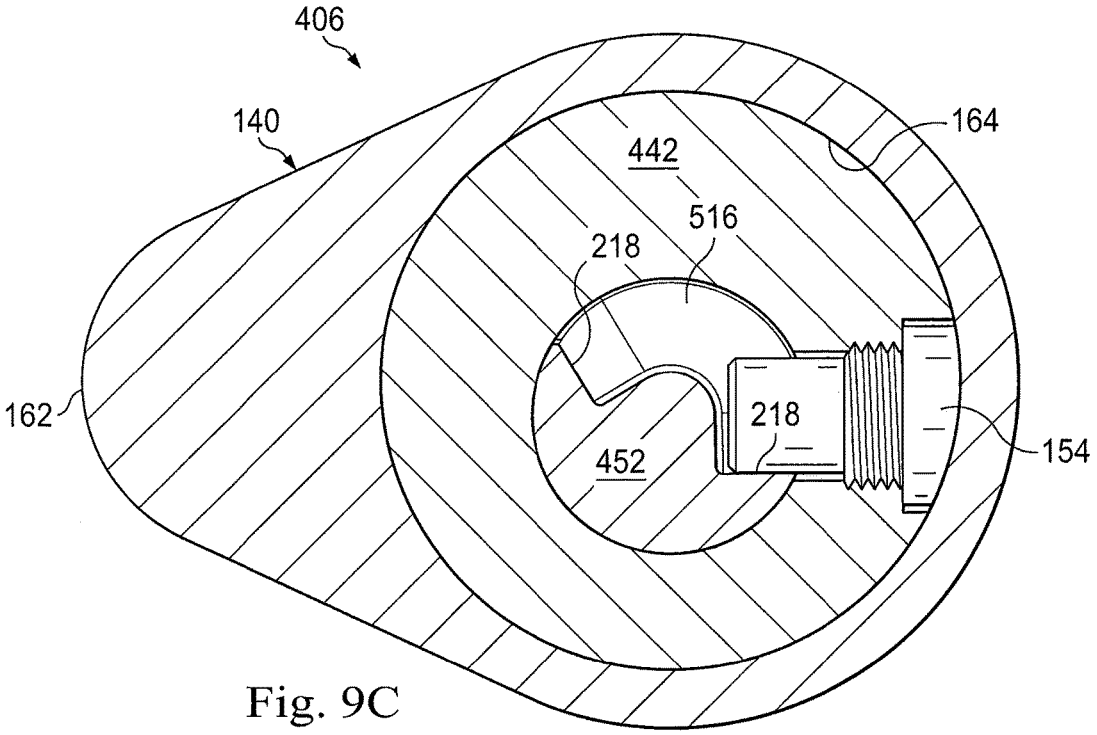
FIG. 9C is a cross-sectional view similar to the view shown in FIG. 5D through a cam rotation stop element of a locking pin assembly in an unlocked position.
Figure 10A:
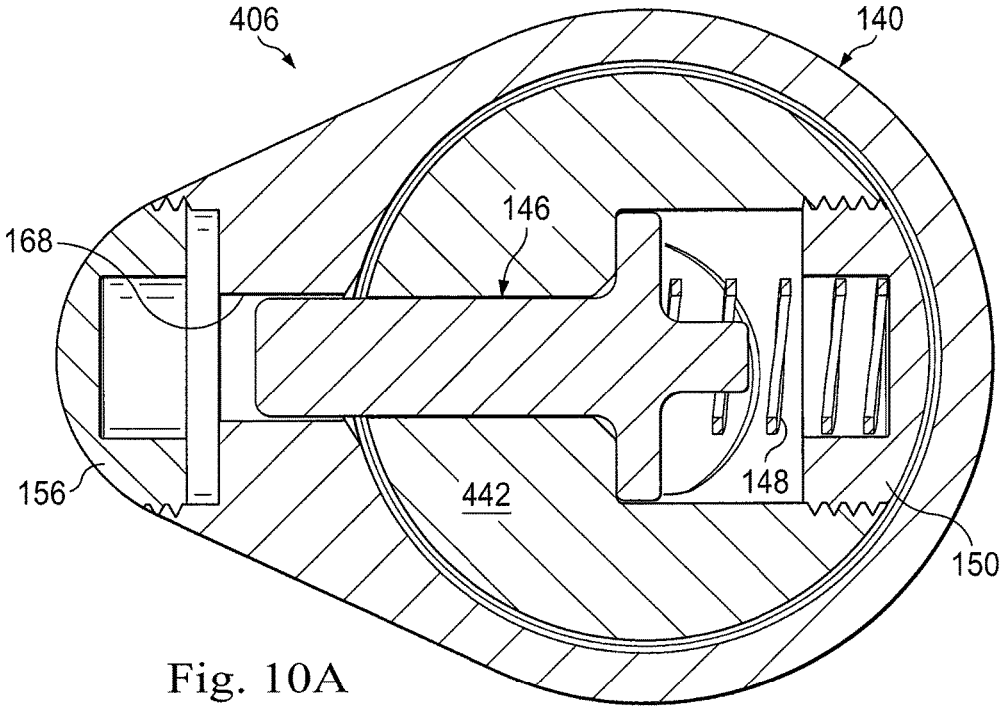
FIG. 10A is a cross-sectional view similar to the view shown in FIG. 6B through a locking element of a locking pin assembly in a locked position.
Figure 10B:
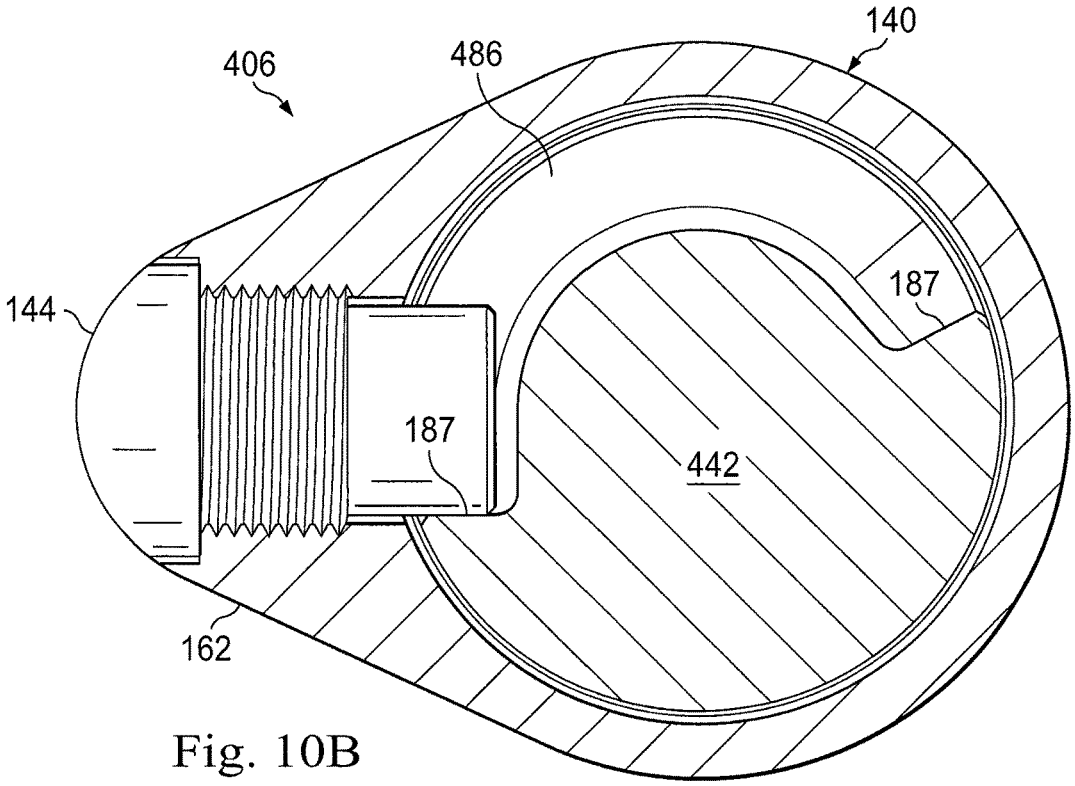
FIG. 10B is a cross-sectional view similar to the view shown in FIG. 6C through a shaft rotation stop element of a locking pin assembly in a locked position.
Figure 10C:
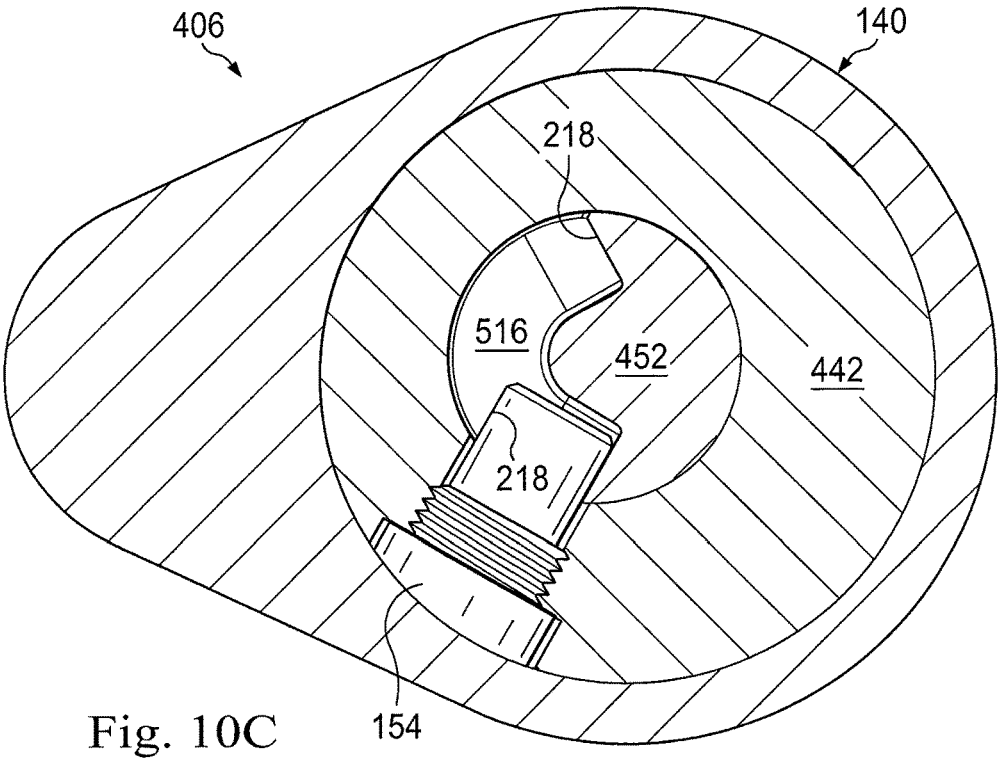
FIG. 10C is a cross-sectional view similar to the view shown in FIG. 6D through a cam rotation stop element of a locking pin assembly in a locked position.

FIGS. 9A, 9B, and 9C show the locking pin assembly 406 when arranged in the unlocked condition. FIGS. 10A, 10B, and 10C show the locking pin assembly 406 when arranged in the locked condition. FIG. 9A shows the locking element 146 disposed to rotatably cooperate with the shaft portion 442 and the locking bore 168.

Referring to FIG. 9B, in this implementation, the locking pin assembly 406 includes a circumferentially extending lock groove 486 formed in an outer surface of the shaft portion 442. Here, the lock groove 486 may extend through an arc that permits rotation of about 120 degrees when cooperating with the shaft rotation stop element 144. Accordingly, to accommodate the width of the shaft rotation stop element 144, the lock groove 486 may extend between about 125-145 degrees. However, other implementations have a lock groove 486 extending through a larger or smaller arc. In some implementations, the lock groove 486 may permit rotation less than 120 degrees, while other implementations may permit rotation greater than 120°. In some implementations, the lock groove 486 may be arranged to permit rotation of about 90°. Other implementations may permit rotation in the range of 80° to 190°. Yet other ranges are contemplated. The lock groove 486 may cooperate with the shaft rotation stop element 144 to limit the amount of rotation that can occur relative to the body portion 140. The lock groove 486 includes the ends 187 that may be used as rotation stops to limit rotation of the shaft portion 442 relative to the body portion 140 and the shaft rotation stop element 144.

FIG. 9C shows the camshaft 452 rotatably disposed within the shaft portion 442. The external surface of the camshaft 452 includes a lock groove 516 that circumferentially extends about the camshaft 452. In this embodiment, the lock groove 516 may extend through an arc within a range of 90 and 340°, or other ranges as described above with reference to the lock groove 216 in FIG. 5D.

FIGS. 10A, 10B, and 10C show the locking pin assembly 406 when arranged in the locked condition. As can be seen in FIG. 10A, in the locked condition, the locking element 146 has been rotated to project into the locking bore 168 of the body 140. As shown in FIG. 10B and as described herein with reference to the locking pin assembly 106, the shaft portion 442 is rotated relative to the shaft rotation stop element 144 until the shaft rotation stop element 144 engages against the ends 187 of the lock groove 486. FIG. 10C shows the camshaft 452 rotated relative to the shaft portion 442 and relative to the cam rotation stop element 154. Here, the cam rotation stop element 154 has passed the lock groove 516 from one end 218 to the other.

Figure 11A:
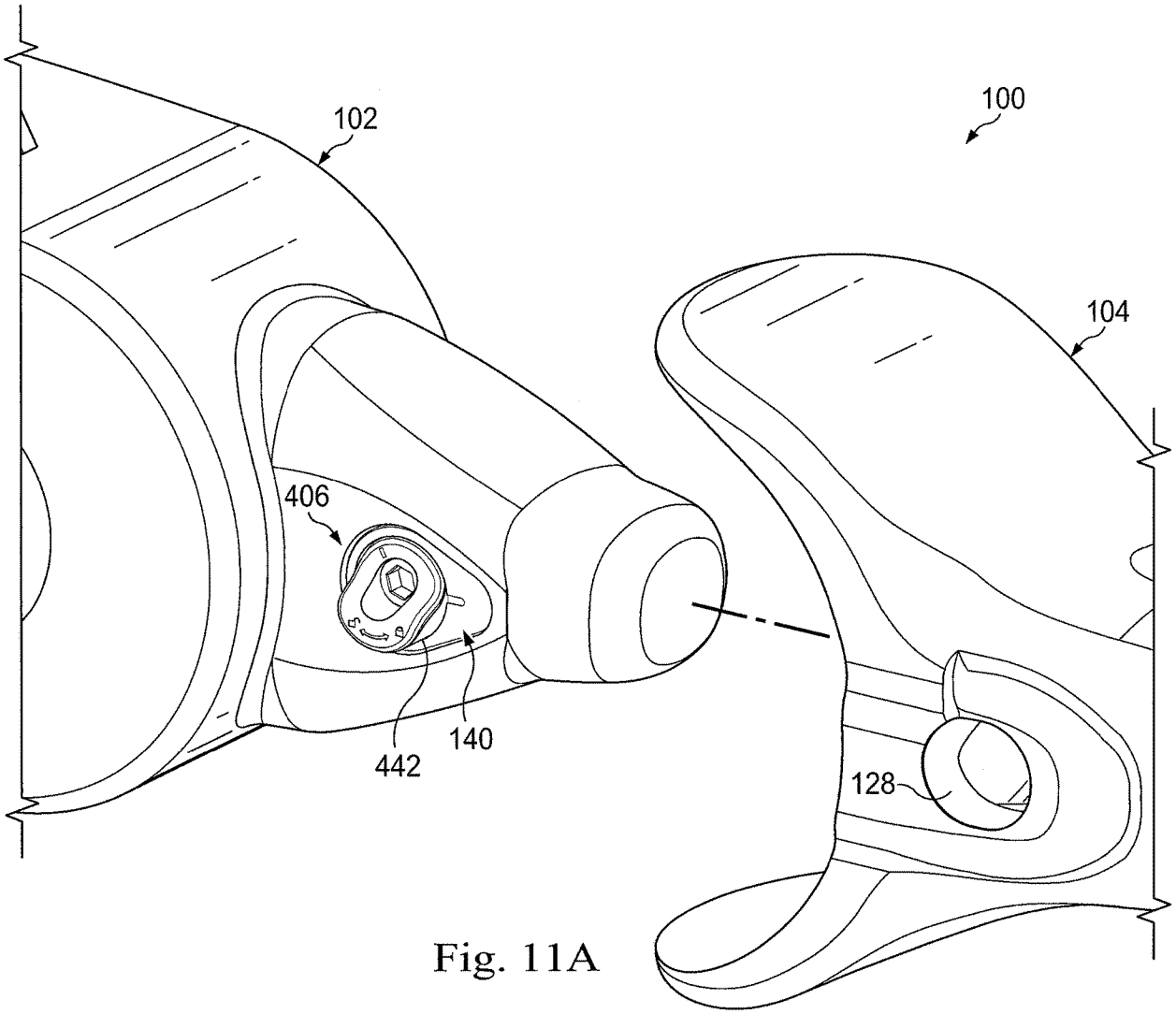
FIG. 11A is a perspective view of an excavating tooth assembly with the locking pin assembly disposed in an adapter in an unlocked position to receive a wear member.
Figure 11B:
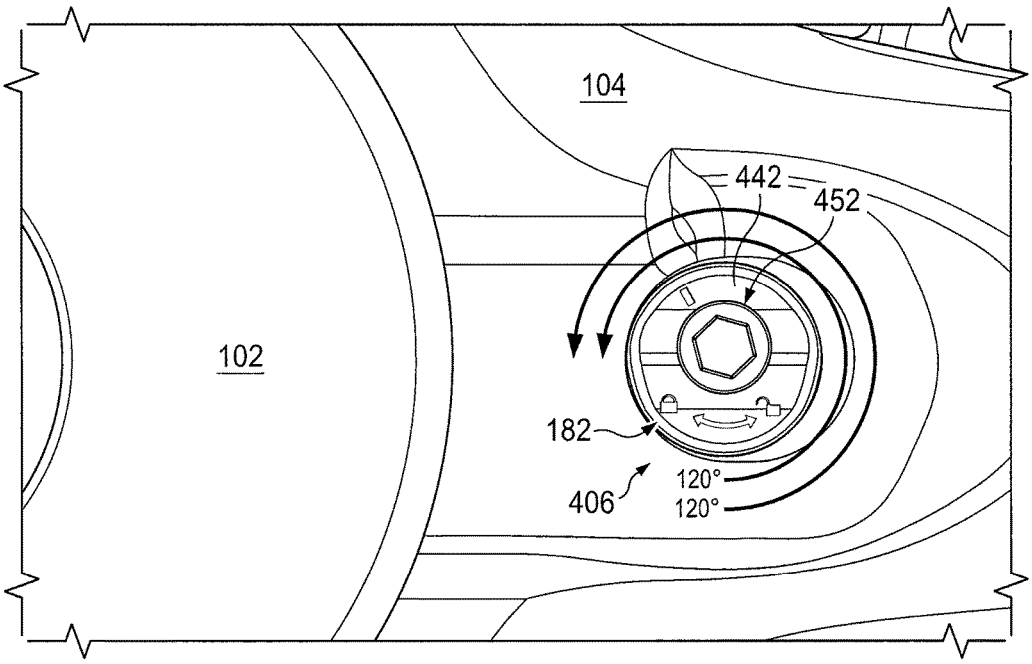
FIG. 11B shows the wear member assembled on the adapter with the locking pin assembly in an unlocked position and shows the movement required to change the locking pin assembly from the unlocked position to a locked position.
Figure 11C:
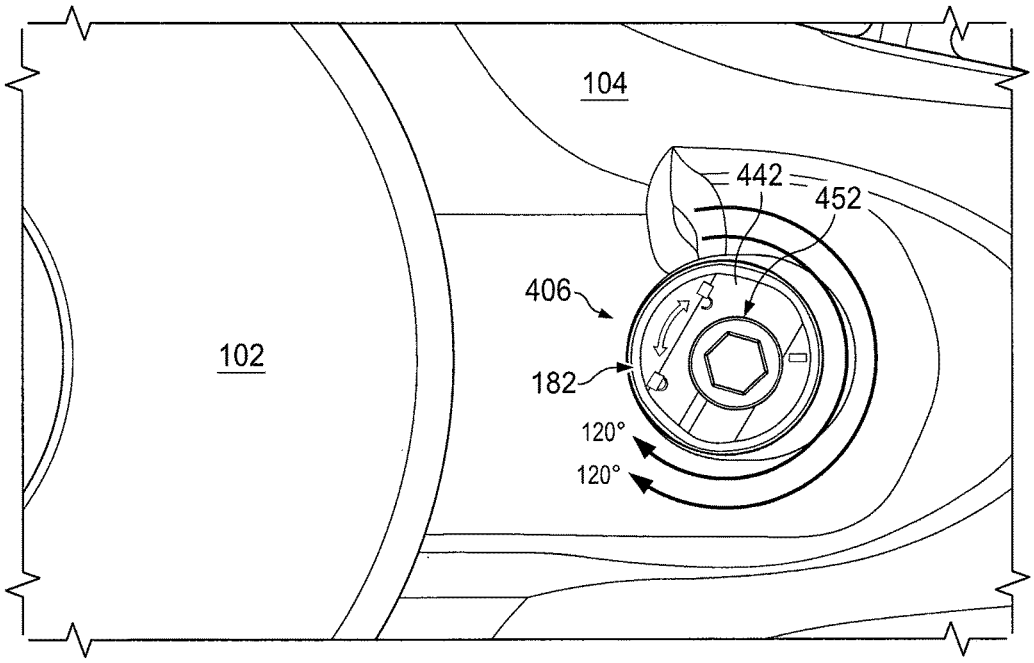
FIG. 11C shows the wear member assembled on the adapter with the locking pin assembly in a locked position.

FIGS. 11A, 11B, and 11C show an exemplary process for installing the tooth point 104 to the adapter 102. Since the process is similar in many respects to the process described with reference to FIGS. 7A through 7E, only differences will be described herein. FIGS. 7A-7E show an embodiment where the camshaft 152 rotates 120 degrees and the shaft portion 142 rotates 240° when the locking pin assembly 106 is adjusted between the locked and unlocked position, although other embodiments are contemplated. FIGS. 11A, 11B, and 11C show that the camshaft 452 may rotate 120° and that the shaft portion 142 may also rotate 120° when the locking pin assembly 406 is adjusted between the lock and unlock positions, although other embodiments are contemplated. The rotation range may be controlled and adjusted by controlling or adjusting the length of the arc of the lock grooves in the shaft portion and the camshaft. Accordingly, since the lock groove 486 in the shaft portion 442 in FIG. 9B is shorter or has a smaller angle range than the lock groove 186 in the shaft portion 142 in FIG. 5C, the locking pin assembly 406 moves through a shorter or smaller angle range than the locking pin assembly 106.

The locking pin assemblies described herein may provide advantages and benefits not found in conventional devices. For example, because of the two step rotation process to lock and unlock the locking pin assembly, it may be more resistant to inadvertent unlocking then some conventional pin assemblies. For example, it may better withstand vibration, high impact, and cyclic loading that may occur during use of ground engaging tools. While described with reference to a tooth point and an adapter, it should be understood that the locking pin assembly may find use in other applications. For example and without limitation, the locking pin assembly may be used to attach an adapter to a bucket or other structures in the ground engaging tool industry.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A locking pin assembly for securing a ground engaging element having at least one side opening to a support structure alignable with the at least one side opening, the locking pin assembly comprising:

a body portion having a non-circular profile and being arranged to non-rotatably, selectively extend into the support structure;

a shaft portion disposed within the body portion and rotatable between a locking position and a release position, the shaft portion having an opening formed therein;

a camshaft rotatably disposed within the opening of the shaft portion, the camshaft being arranged to cooperate with the shaft portion to freely rotate within the shaft portion through a first range of motion and to apply a rotational force on the shaft portion through a second range of motion; and a radially extending locking element carried by one of the shaft portion and the body portion and configured to selectively mechanically interfere with the other of the shaft portion and the body portion to selectively prevent rotation of the shaft portion relative to the body portion.

2. The locking pin assembly of claim 1, wherein the locking element comprises a lock portion and a cam interfacing portion, the cam interfacing portion being selectively engageable with the camshaft.

3. The locking pin assembly of claim 1, comprising a biasing element carried by the shaft portion, the biasing element biasing the locking element to a position that mechanically engages with the body portion.

4. The locking pin assembly of claim 3, wherein the camshaft is rotatable about an axis substantially parallel to an axis of the shaft portion, the camshaft interacting with the locking element against a force applied by the biasing element to radially displace the locking element.

5. The locking pin assembly of claim 1, wherein the shaft portion comprises a groove formed therein, and wherein the body portion carries a rotation stopping element, the rotation stopping element mechanically interfering with a portion of the groove to limit a range of rotation of the shaft portion relative to the body portion.

6. The locking pin assembly of claim 5, wherein the body portion comprises an inner surface with a radially extending opening therein, the locking element being configured to automatically enter the radially extending opening therein when the locking element is aligned with the radially extending opening.

7. The locking pin assembly of claim 1, wherein the camshaft comprises a groove formed therein, and wherein the shaft portion carries a rotation stopping element, the rotation stopping element mechanically interfering with a portion of the groove to limit a range of rotation of the camshaft relative to the shaft portion.

8. The locking pin assembly of claim 7, wherein the camshaft transfers applied torque loading to the shaft portion only after the camshaft reaches a rotational limit.

9. The locking pin assembly of claim 7, wherein the groove of the camshaft is a partially circumferential groove having end portions, the rotation stopping element being fixed in place relative to the shaft portion and selectively engageable with the end portions to prevent rotation of the camshaft relative to the shaft portion when the range of rotation is exceeded.

10. A locking pin assembly for securing a ground engaging element having at least one side opening to a support structure having a passage alignable with the at least one side opening, the locking pin assembly comprising:

a body portion sized and shaped to be introduced into the passage of the support structure, the body portion having a first opening formed therein;

a shaft portion disposed in the first opening in the body portion and rotatable between a locked position and an unlocked position, the shaft portion being rotatable within the body portion within a first limited range of motion and having a first rotation limit relative to the body portion; and a radially extending locking element carried by one of the shaft portion and the body portion and configured to project into the other of the shaft portion and the body portion to prevent rotation in both the first direction and an opposing second direction.

11. The locking pin assembly of claim 10, wherein the shaft portion comprises a second opening formed therein, the locking pin assembly comprising a camshaft rotatably disposed in the second opening of the shaft portion, the camshaft being rotatable within a second limited range of motion and having a second rotation limit relative to the shaft portion, the camshaft being arranged to rotate the shaft portion when the camshaft reaches the second rotation limit.

12. The locking pin assembly of claim 11, wherein the locking element comprises a lock portion and a cam interfacing portion, the cam interfacing portion being selectively engageable with the camshaft.

13. The locking pin assembly of claim 11, comprising a biasing element carried by the shaft portion, the biasing element biasing the locking element to a position that mechanically engages with the body portion.

14. The locking pin assembly of claim 13, wherein the camshaft is rotatable about an axis substantially parallel to an axis of the shaft portion, the camshaft interacting with the locking element against a force applied by the biasing element to radially displace the locking element.

15. The locking pin assembly of claim 11, wherein the shaft portion comprises a groove formed therein, and wherein the body portion carries a rotation stopping element, the rotation stopping element mechanically interfering with a portion of the groove to limit a range of rotation of the shaft portion relative to the body portion.

16. The locking pin assembly of claim 11, wherein the camshaft comprises a groove formed therein, and wherein the shaft portion carries a rotation stopping element, the rotation stopping element mechanically interfering with a portion of the groove to limit a range of rotation of the camshaft relative to the shaft portion.

17. A method for locking a wear member to or unlocking a wear member from an adapter carried on earth engaging equipment using a locking pin assembly, the method comprising:

introducing the locking pin assembly into the wear member or the adapter; and rotating a shaft portion relative to a body portion in a first direction through a first range of motion until a locking element carried by one of the shaft portion and the body portion radially displaces into a locking bore in the other of the shaft portion and the body portion and prevents further rotation of the shaft portion relative to the body portion in the first direction and in an opposing second direction so that locking pin assembly prevents removal of the wear member from the adapter.

18. The method of claim 17, comprising:

prior to rotating the shaft portion, rotating a camshaft relative to the shaft portion in the first direction through a first range of motion until the camshaft engages a stop element on the shaft portion.

19. The method of claim 18, comprising:

rotating the camshaft relative to the shaft portion in the second direction until the camshaft displaces the locking element so that the locking element no longer prevents rotation of the shaft portion relative to the body portion in the second direction; and rotating the shaft portion relative to the body portion in the second direction by continuing to rotate the camshaft until the shaft portion is positioned to permit removal of a wear member from the adapter.

20. The method of claim 19, wherein rotating the camshaft relative to the shaft portion in the second direction until the camshaft displaces the locking element comprises:

compressing a biasing element that biases the locking element toward a locked position.

21. A locking pin assembly for securing a ground engaging element having at least one side opening to a support structure alignable with the at least one side opening, the locking pin assembly comprising:

a first shaft portion rotatable between a first position and a second position, the first shaft portion having opening formed therein;

a second shaft portion rotatably disposed within the opening of the first shaft portion and rotatable relative to the first shaft portion, the second shaft portion being arranged to cooperate with the first shaft portion to rotate within the first shaft portion through a first range of motion and to apply a rotational force on the first shaft portion through a second range of motion; and a radially extending locking element carried by one of the first shaft portion and the second shaft portion and configured to selectively radially project and retract to selectively prevent rotation of one of the first shaft portion and the second shaft portion relative to the ground engaging element.

22. The locking pin assembly of claim 21, wherein the locking element comprises a lock portion and a cam interfacing portion, and wherein the locking pin assembly comprises a cam, the cam interfacing portion being selectively engageable with the cam to retract the locking element.

23. The locking pin assembly of claim 21, comprising a biasing element carried by one of the first shaft portion and the second shaft portion, the biasing element biasing the locking element to a position that mechanically prevents rotation of one of the first shaft portion and the second shaft portion relative to the ground engaging element.

* * * * *